US010829900B2

(12) United States Patent
Merrill et al.

(10) Patent No.: US 10,829,900 B2
(45) Date of Patent: Nov. 10, 2020

(54) AUTOMATED RUMBLE STRIP ASSEMBLY

(71) Applicant: THE BOARD OF REGENTS OF THE NEVADA SYSTEM OF HIGHER EDUCATION ON BEHALF OF THE UNIV. OF NEVADA, Las Vegas, NV (US)

(72) Inventors: Steve Merrill, Minden, NV (US); Alexander Paz, Henderson, NV (US)

(73) Assignee: THE BOARD OF REGENTS OF THE NEVADA SYSTEM OF HIGHER EDUCATION ON BEHALF OF THE UNIVERSITY OF NEVADA, LAS VEGAS, Las Vegas, NV (US)

( * ) Notice: Subject to any disclaimer, the term of this patent is extended or adjusted under 35 U.S.C. 154(b) by 337 days.

(21) Appl. No.: 15/233,535

(22) Filed: Aug. 10, 2016

(65) Prior Publication Data

US 2018/0044866 A1 Feb. 15, 2018

(51) Int. Cl.
*E01F 9/529* (2016.01)

(52) U.S. Cl.
CPC ..... *E01F 9/529* (2016.02)

(58) Field of Classification Search
CPC ..... E01F 9/529
USPC ..... 404/9, 10, 11, 15
See application file for complete search history.

(56) References Cited

U.S. PATENT DOCUMENTS 1,356,922 A * 10/1920 Keenan ..... E01F 13/08 49/131
1,365,165 A 1/1921 Garcia
1,497,073 A 6/1924 Doyle
1,649,877 A 11/1927 Walston
1,960,376 A * 5/1934 Gilman ..... E01F 13/105 404/6
2,200,739 A 5/1940 Evans
2,244,117 A 6/1941 Preston
(Continued)

FOREIGN PATENT DOCUMENTS

EP 1995381 A2 11/2008
FR 1023189 A1 3/1953
(Continued)

OTHER PUBLICATIONS

International Search Report and Written Opinion for Application No. PCT/US2019/015987 dated May 8, 2019 (10 pages).
(Continued)

*Primary Examiner* — Thomas B Will
*Assistant Examiner* — Katherine J Chu
(74) *Attorney, Agent, or Firm* — Michael Best & Friedrich LLP

(57) ABSTRACT

An automated rumble strip assembly includes a frame having a top surface configured to support a vehicle tire moving along the frame. The automated rumble strip assembly also includes a plurality of elongate members, each elongate member having a top surface. The automated rumble strip assembly also includes an actuator assembly configured to move the elongate members from a first position where each of the top surfaces of the elongate members is flush with the top surface of the frame, to a second position where each of the top surfaces of the elongate members is recessed relative to the top surface of the frame.

22 Claims, 31 Drawing Sheets

(56) References Cited

U.S. PATENT DOCUMENTS

| | | | | |
|---|---|---|---|---|
| 2,457,512 | A | 12/1948 | Wheeler | |
| 3,325,782 | A * | 6/1967 | Der | E01F 13/105 340/935 |
| 3,838,391 | A * | 9/1974 | Mintz | E01F 13/105 340/935 |
| 4,012,156 | A | 3/1977 | Turner et al. | |
| 4,342,525 | A * | 8/1982 | Mastronuzzi, Jr. | E01F 9/529 404/6 |
| 4,775,261 | A * | 10/1988 | Fladung | E01F 13/08 404/6 |
| 4,790,684 | A * | 12/1988 | Adams | E01F 9/529 116/63 R |
| 4,921,074 | A * | 5/1990 | Ochs | B66F 7/26 187/204 |
| 5,479,809 | A * | 1/1996 | Stachuletz | B21B 31/30 72/244 |
| 5,509,753 | A | 4/1996 | Thompson | |
| 5,582,490 | A * | 12/1996 | Murray | E01C 23/088 404/90 |
| 5,676,490 | A * | 10/1997 | Nelson | E01C 23/0993 299/39.4 |
| 6,226,592 | B1 * | 5/2001 | Luckscheiter | B62D 15/025 180/411 |
| 6,997,638 | B2 | 2/2006 | Hensley et al. | |
| 7,011,470 | B1 | 3/2006 | Breazeale et al. | |
| 7,731,448 | B2 * | 6/2010 | Fillie | E01F 9/529 404/15 |
| 8,226,322 | B2 | 7/2012 | Blair | |
| 8,439,594 | B1 * | 5/2013 | Clark | E01F 13/12 256/13.1 |
| 8,623,056 | B2 * | 1/2014 | Linares | A61B 17/7065 606/246 |
| 8,711,004 | B2 | 4/2014 | Gabara et al. | |
| 8,956,072 | B2 | 2/2015 | Brackin et al. | |
| 9,677,232 | B2 * | 6/2017 | Zwerneman | E01F 9/529 |
| 9,683,339 | B2 * | 6/2017 | Thompson | E01F 9/604 |
| 9,689,121 | B2 | 6/2017 | Shi et al. | |
| 9,840,817 | B2 * | 12/2017 | Wallinder | E01F 9/529 |
| 2005/0045914 | A1 * | 3/2005 | Agranat | H01L 21/67132 257/200 |
| 2007/0160420 | A1 | 7/2007 | Aoki | |
| 2010/0075771 | A1 * | 3/2010 | Martens | A63B 67/02 473/160 |
| 2012/0070217 | A1 * | 3/2012 | Hendricks | B41J 25/304 400/352 |
| 2012/0216220 | A1 * | 8/2012 | Huang | G11B 17/0284 720/604 |
| 2013/0189030 | A1 | 7/2013 | Miracle | |
| 2014/0227031 | A1 | 8/2014 | Fifi et al. | |
| 2015/0376849 | A1 * | 12/2015 | Thompson | E01F 9/604 404/15 |
| 2018/0298570 | A1 | 10/2018 | Al-Rubb | |
| 2019/0063019 | A1 | 2/2019 | Collier, Jr. | |

FOREIGN PATENT DOCUMENTS

| | | | |
|---|---|---|---|
| FR | 2927338 | A1 | 8/2009 |
| GB | 2079356 | A | 1/1982 |
| GB | 2296277 | A | 6/1996 |
| GB | 2397603 | A | 7/2004 |
| JP | 05065708 | A | 3/1993 |
| JP | 2001152417 | A | 6/2001 |
| WO | 94/19544 | A1 | 9/1994 |
| WO | 2008/129108 | A1 | 10/2008 |
| WO | 2012/057679 | A1 | 5/2012 |
| WO | 2014102411 | A1 | 7/2014 |
| WO | 2017/094037 | A1 | 6/2017 |
| WO | 2019/017760 | A1 | 1/2019 |

OTHER PUBLICATIONS

Nevada Department of Transportation, "Prototyping and Field Testing of a Demand-Responsive Rumble Strip Mechanism," NDOT Research Report No. 224-14-803 TO Jul. 17, 2018, 186 pages.

Office Action from U.S. Patent and Trademark Office for U.S. Appl. No. 15/892,659 dated Sep. 30, 2019 (13 pages).

* cited by examiner

AUTOMATED RUMBLE STRIP ASSEMBLY

BACKGROUND

The present disclosure relates to rumble strip assemblies, and to the use of rumble strip assemblies to raise levels of driver attention on roadways.

Driver errors due to lack of driver attention and distracted driving contribute significantly to the occurrence and the severity of vehicle crashes, and to pedestrian injuries and fatalities. However, changing driver behavior is difficult. While law enforcement is an effective mechanism to improve driver behavior (e.g., through issuance of tickets and monitoring/patrol), it is impossible both from a cost and logistical standpoint to have law enforcement presence at each and every location along a roadway. Thus, there is a need for systems and mechanisms that will effectively raise levels of driver attention on roadways, and that will facilitate a reduction in the number and/or severity of crashes.

SUMMARY

In accordance with one construction, an automated rumble strip assembly includes a frame having a top surface configured to support a vehicle tire moving along the frame. The automated rumble strip assembly also includes a plurality of elongate members, each elongate member having a top surface. The automated rumble strip assembly also includes an actuator assembly configured to move the elongate members from a first position where each of the top surfaces of the elongate members is flush with the top surface of the frame, to a second position where each of the top surfaces of the elongate members is recessed relative to the top surface of the frame.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

FIGS. 1-22 illustrate an automated rumble strip assembly 10. The automated rumble strip assembly 10 may be used to raise a level of driver attention on roadways, and to facilitate a reduction in a number and/or severity of crashes. In some constructions, the automated rumble strip assembly 10 is sized and shaped to be integrally formed as part of a newly constructed roadway. In other constructions, the rumble strip assembly 10 is sized and shaped so as to be a retrofit for an existing roadway.

Figure 1:
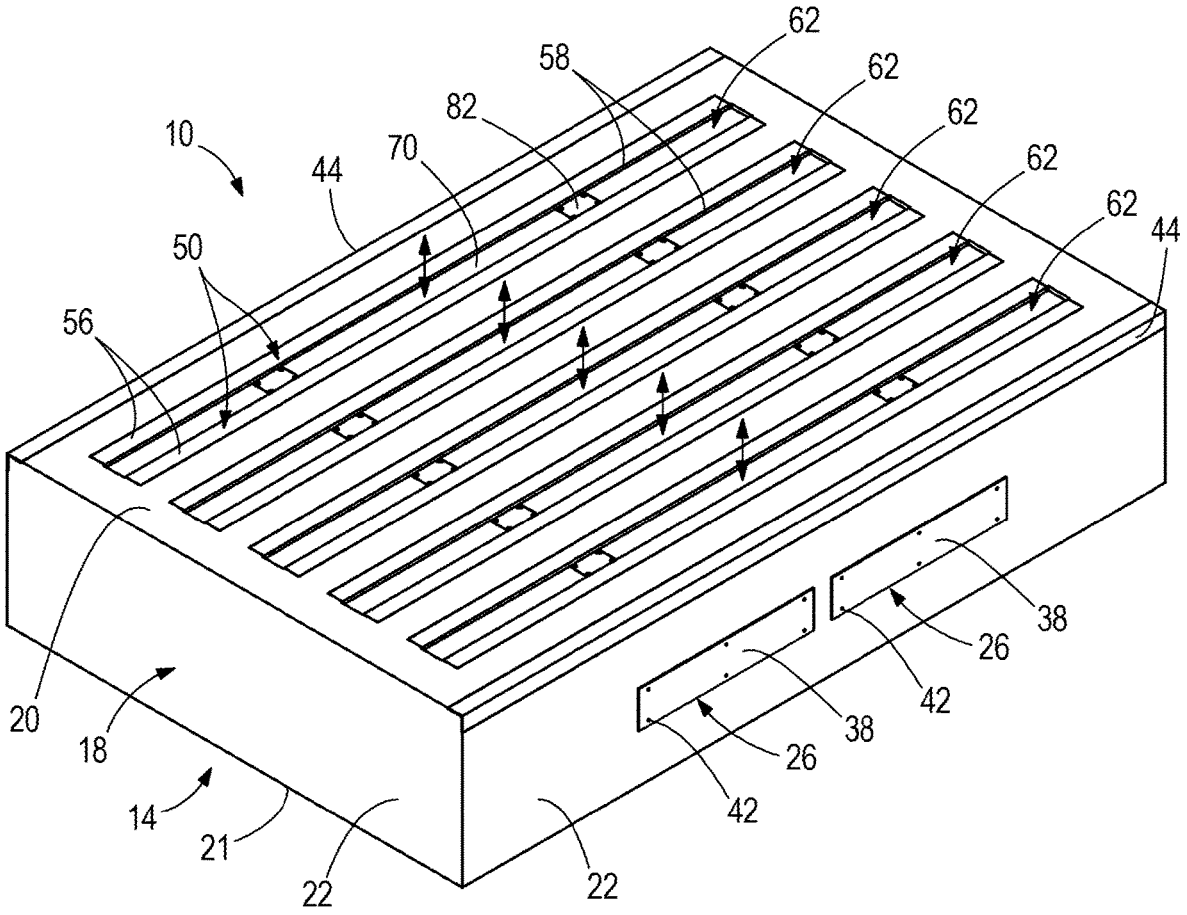
FIG. 1 is a perspective view of an automated rumble strip assembly according to one embodiment.
Figure 2:
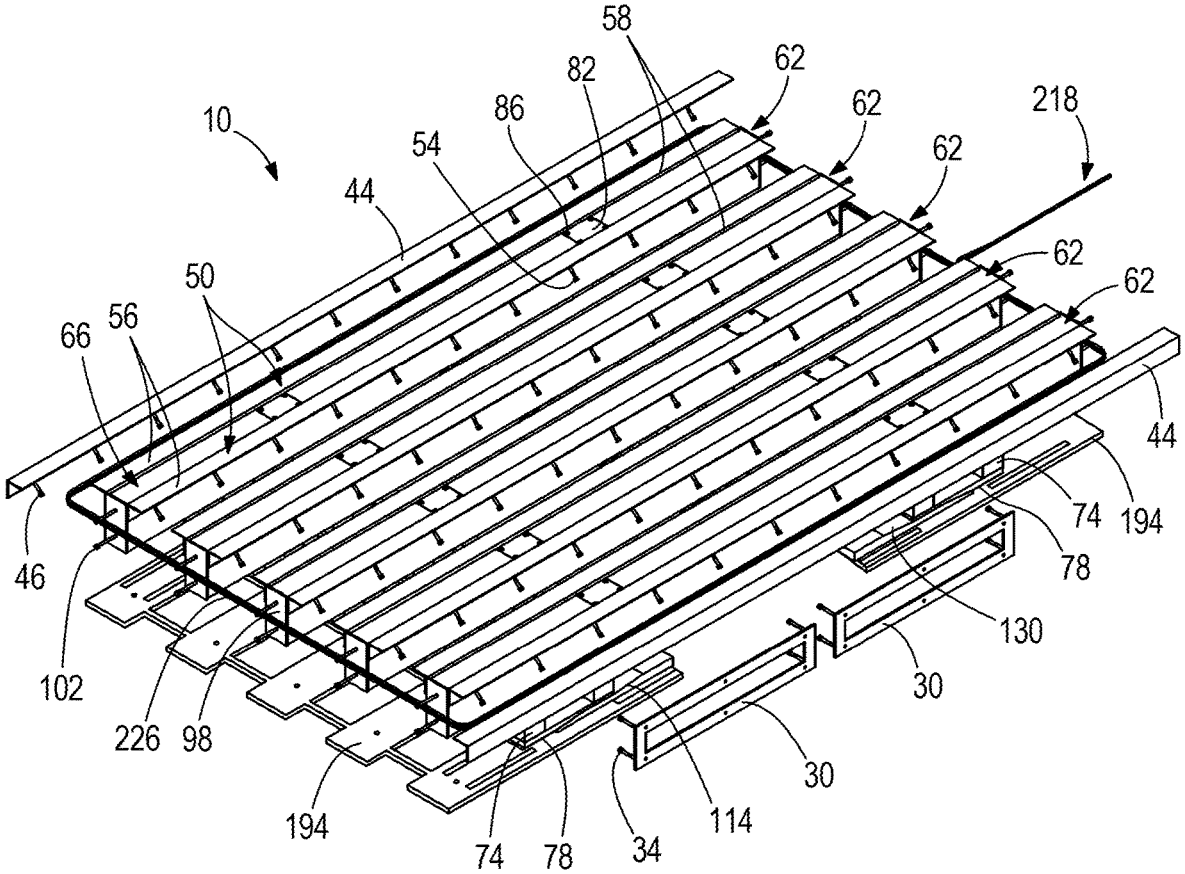
FIG. 2 is a perspective view of the automated rumble strip assembly, with a frame removed.
Figure 3:
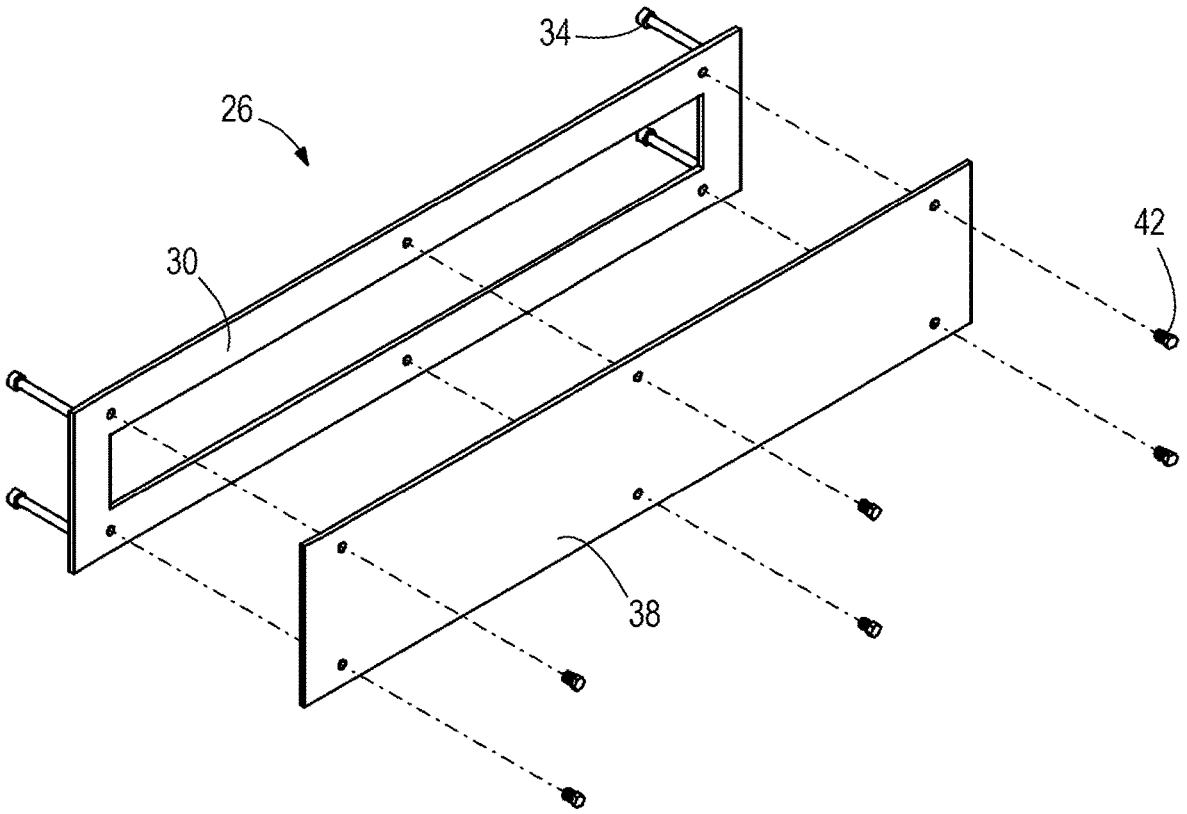
FIG. 3 is a perspective, exploded view of an access frame and an access plate of the automated rumble strip assembly.

With reference to FIGS. 1-3, the automated rumble strip assembly 10 includes a frame 14. In the illustrated construction the frame 14 is a generally box-like structure. In other constructions the frame 14 has other shapes and/or sizes than that illustrated. The frame 14 includes a main housing 18 having a top surface 20 (e.g., a planar top surface), a bottom surface 21, and at least one side surface 22 that extends (e.g., perpendicularly and downwardly) from the top surface 20. In the illustrated construction the main housing 18 is made of concrete, although in other constructions the main housing 18 is made of material other than concrete.

With continued reference to FIGS. 1-3, the frame 14 also includes access assemblies 26 disposed along one of the side surfaces 22. Each access assembly 26 includes its own access frame 30 (FIGS. 2 and 3) coupled to one of the side surfaces 22 with welded studs 34, and an access plate 38 coupled to the access frame 30 with access plate bolts 42 (FIGS. 1 and 3). The access plates 38 may be removed to access components inside of the main housing 18, and to inspect, repair and/or replace the components. While the illustrated construction includes two access assemblies 26, other constructions include different numbers of access assemblies 26 than that illustrated. In some constructions, the frame 14 does not include any access assemblies 26. In some constructions, the access assembly or assemblies 26 are located along a different side surface 22 than that illustrated, or are located along the top surface 20 of the main housing 18.

With reference to FIGS. 1 and 2, the frame 14 also includes edge plates 44 that provide added structural stability to the automated rumble strip assembly 10. In the illustrated construction the frame 14 includes two edge plates 44 that fit over opposite edges of the main housing 18, and are coupled to the main housing 18 with welded studs 46 (FIG. 2). The edge plates 44 each have a generally L-shaped angled profile, with one portion of each of the L-shaped angled profiles contacting the top surface 20 of the main housing 18, and the other portion contacting one of the side surfaces 22. In some constructions, the frame 14 includes a different number of edge plates 44 than that illustrated, and/or includes edge plates 44 having different shapes and/or sizes than that illustrated. In some constructions, the frame 14 does not include any edge plates 44.

With continued reference to FIGS. 1 and 2, the frame 14 further includes guiding angle plates 50 that provide added structural stability to the automated rumble strip assembly 10. In the illustrated construction, the frame 14 includes five pairs of guiding angle plates 50 that are each coupled to the top surface 20 of the main housing 18 with welded studs 54 (FIG. 2), and extend parallel to one another along the top surface 20. The guiding angle plates 50 each include a top surface 56 (e.g., a planar top surface). In some constructions, the frame 14 includes a different number of guiding angle plates 50 than that illustrated, and/or includes guiding angle plates 50 having different shapes and/or sizes than that illustrated. In some constructions, the frame 14 does not include any guiding angle plates 50.

Figure 15:
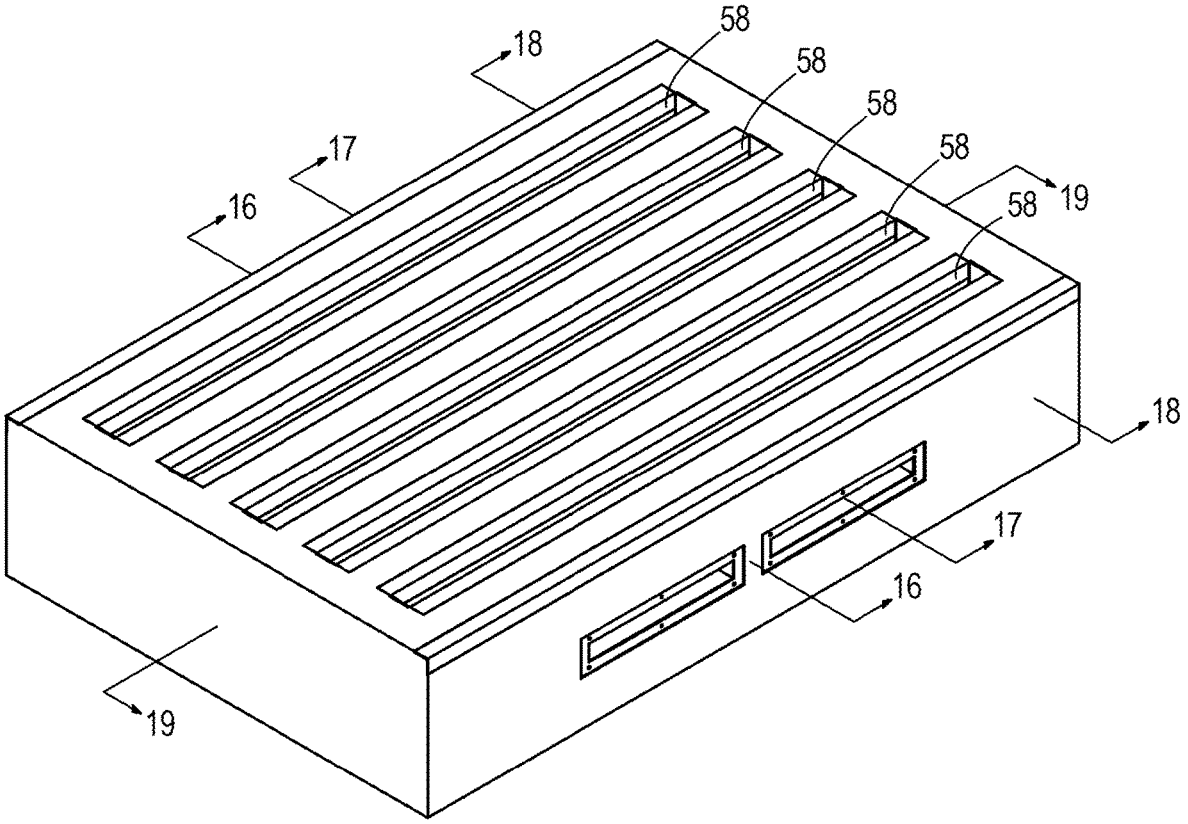
FIG. 15 is a perspective view of the automated rumble strip assembly, with the elongate members removed.
Figure 16:
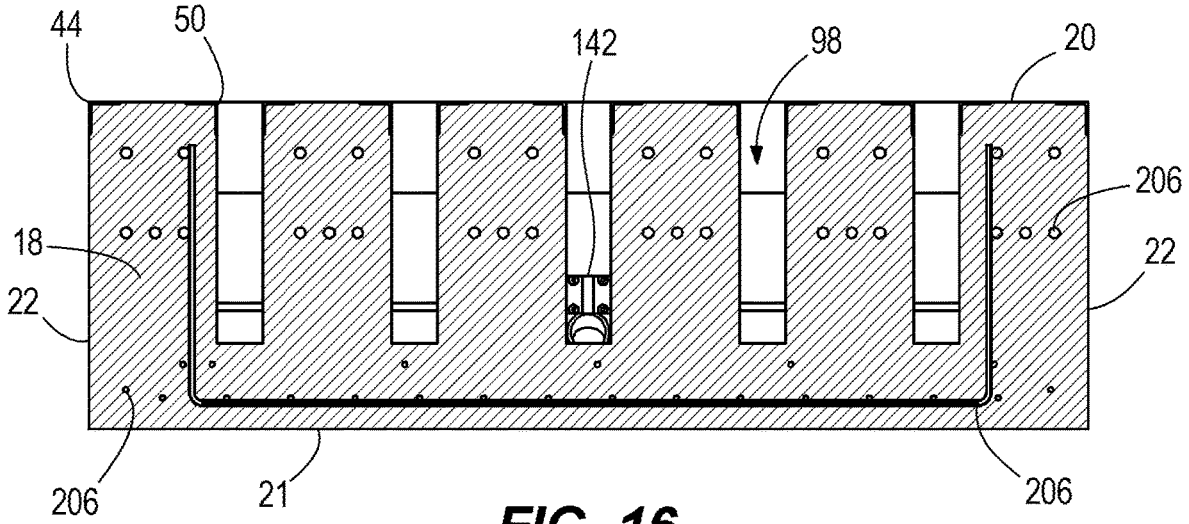
FIG. 16 is a cross-sectional view of the automated rumble strip assembly, taken along lines 16-16 in FIG. 15.

With reference to FIGS. 1 and 15, the frame 14 also includes a plurality of elongate apertures 58 that are open and exposed along the top surface 20 of the main housing 18. As illustrated in FIG. 1, each of the elongate apertures 58 is positioned between a pair of the guiding angle plates 50, and extends parallel to each of the other elongate apertures 58.

With reference to FIGS. 1, 2, and 4-6, the automated rumble strip assembly 10 also includes a plurality of movable, elongate members 62 that are disposed at least partially within the frame 14. In the illustrated construction the automated rumble strip assembly 10 includes five elongate members 62 that are spaced equally apart from one another and are parallel to one another. However, in other constructions the number and/or arrangement of elongate members 62 is different.

Figure 4:
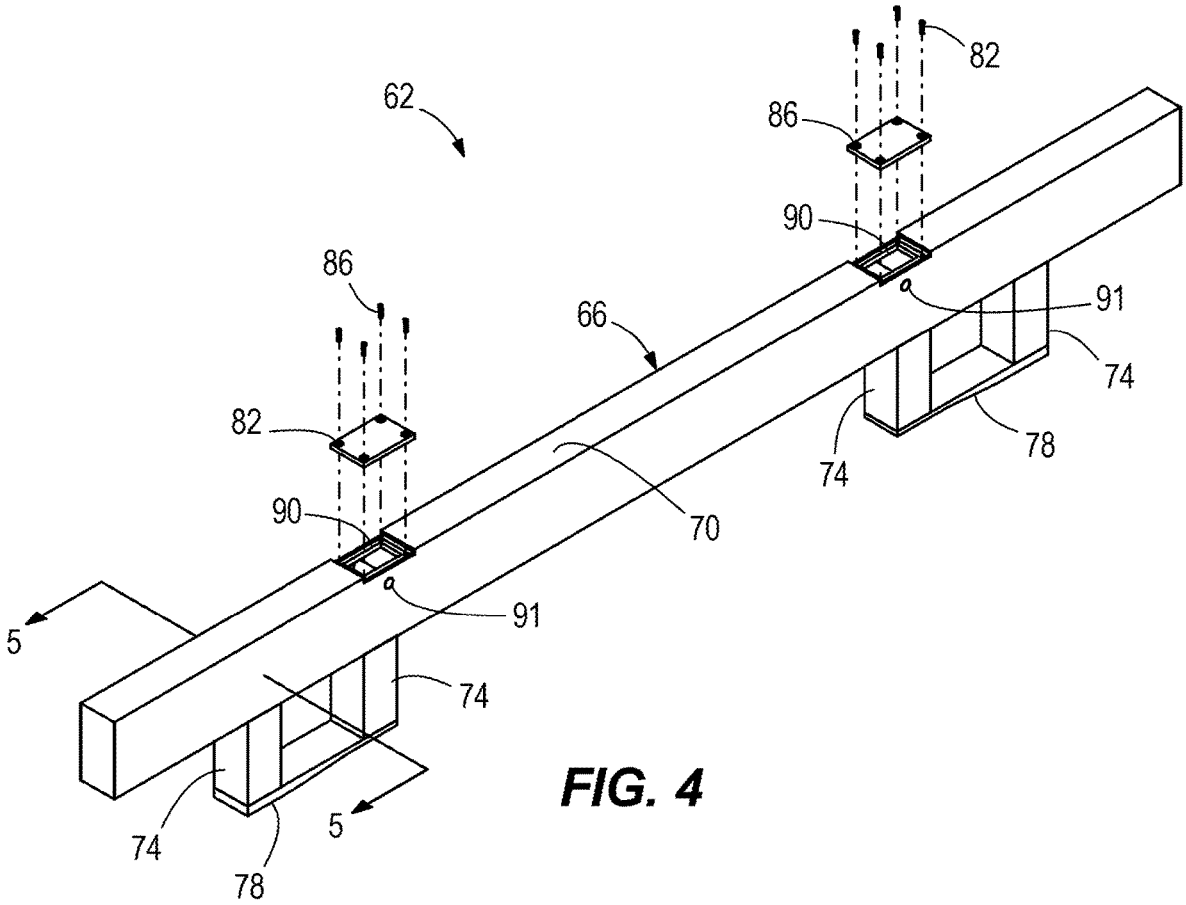
FIG. 4 is a perspective, exploded view of an elongate member of the automated rumble strip assembly.

With reference to FIG. 4, each of the elongate members 62 includes an upper body 66. Each of the upper bodies 66 is generally rectangular in cross-section, and includes a top surface 70. In the illustrated construction, each of upper bodies 66 is sized and shaped to move within one of the elongate apertures 58 (e.g., along the direction of the arrows in FIG. 1).

With continued reference to FIG. 4, each of the elongate members 62 also includes at least one support member 74 coupled to and extending beneath the upper body 66. The support members 74 support the upper body 66. In the illustrated construction, each of the elongate members 62 includes four support members 74 extending perpendicularly below the upper body 66. In other constructions, the elongate members 62 include a different number and/or arrangement of support members 74.

With continued reference to FIG. 4, each of the elongate members 62 includes at least one base portion 78 that is coupled to and disposed below the support member 74. In the illustrated construction, each of the elongate members 62 includes two base portions 78. Each of the base portions 78 is coupled to two of the support members 74. In other constructions, the elongate members 62 include a different number and/or arrangement of base portions 78.

With continued reference to FIG. 4, each of the elongate members 62 also includes at least one elongate member access plate 82 that is coupled to the upper body 66 with bolts 86. When the access plate 82 is removed, an access frame 90 and lifting rod 91 are exposed inside of the upper body 66. In some constructions, the lifting rod 91 may be used to lift and/or move the elongate member 62. While the illustrated construction includes two access plates 82, other constructions include different numbers of access plates 82 than that illustrated. In some constructions, the elongate members 62 do not include any access plates 82, access plate frames 90, and/or lifting rods 91. In some constructions, the access plates 82 are located along a different surface of the elongate member 62 than that illustrated.

Figure 5:
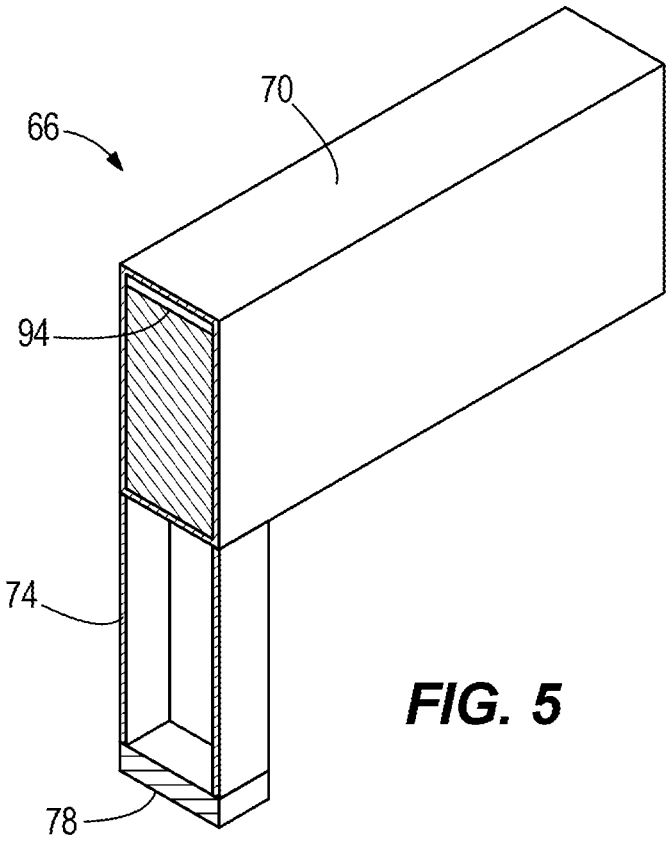
FIG. 5 is a cross-sectional view of the elongate member, taken through lines 5-5 in FIG. 4.

With reference to FIG. 5, each elongate member 62 also includes a dampening material 94 disposed within the upper body 66. The dampening material 94 at least partially fills an interior, hollow space in the upper body 66, and acts to dampen sound and/or vibrations as a vehicle travels over the automated rumble strip assembly 10. In some constructions, the dampening material is sand or fluid such as water or oil, although other constructions include different materials. In some constructions, the upper body 66 does not include any dampening material.

Figure 6:
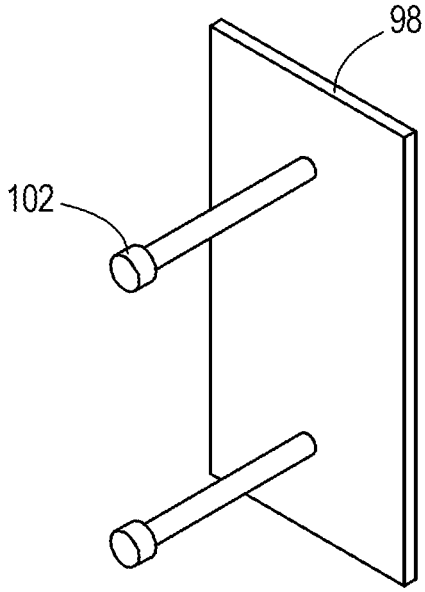
FIG. 6 is a perspective view of an end plate of the automated rumble strip assembly.
Figure 7:
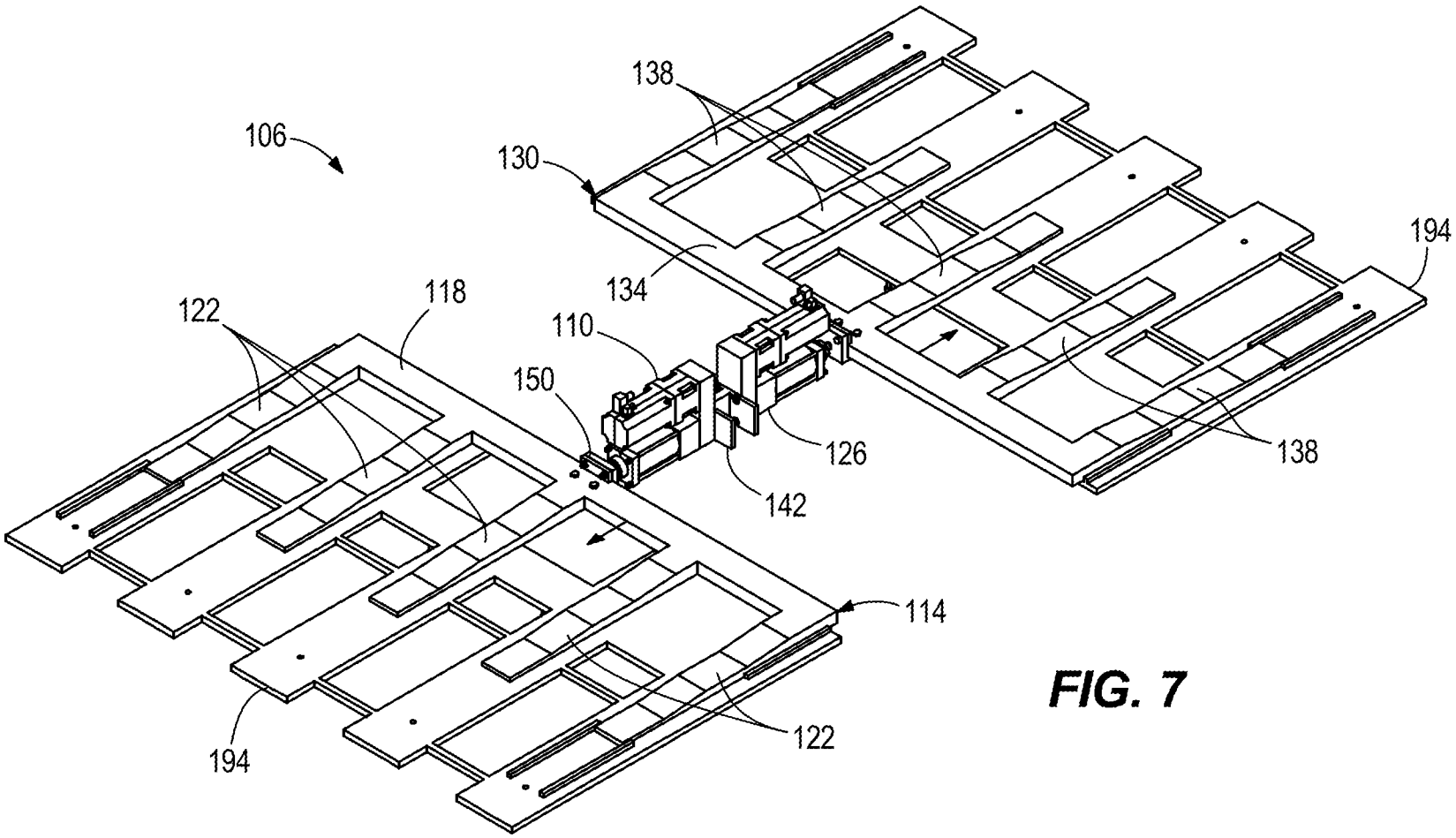
FIG. 7 is a perspective view of an actuator assembly of the automated rumble strip assembly.

With reference to FIGS. 2 and 6, the automated rumble strip assembly 10 also includes end plates 98 that are coupled to the main body 18, to provide added structural stability to the automated rumble strip assembly 10 and guidance for the elongate members 62. In the illustrated construction, the end plates 98 are coupled to the main body 18 with welded studs 102. In some constructions the automated rumble strip assembly 10 does not include end plates 98.

With reference to FIGS. 7-12, the rumble strip assembly 10 also includes an actuator assembly 106. In the illustrated construction, the actuator assembly 106 is disposed entirely within the main housing 18 of the frame 14. However, in other construction at least a portion of the actuator assembly 106 is disposed outside of the main housing 18. The actuator assembly 106 that moves the elongate members 62 from a first position (FIGS. 1, 10A, 10B) where each of the top surfaces 70 (FIGS. 4 and 5) of the elongate members 62 is at a first distance relative to a top surface of the frame 14, to a second position (FIGS. 11A, 11B) where each of the top surfaces 70 of the elongate members 62 is at a second, different distance relative to the top surface of the frame 14. In the illustrated construction, the top surface of the frame 14 corresponds to the top surfaces 56 of the guiding angle plates 50. In some constructions, the top surface of the frame 14 corresponds to the top surface 20 of the main housing 18. In the illustrated construction, each of the top surfaces 70 is flush relative to the top surface of the frame 14 in the first position, and is recessed relative to the top surface of the frame 14 in the second position.

With continued reference to FIGS. 7-12, the actuator assembly 106 includes a first motor 110 and a first wedge plate 114 coupled to and driven linearly by the first motor 110. In the illustrated construction, the first wedge plate 114 includes a first main body 118 and five separate first arms 122 (FIGS. 7 and 8) that extend parallel to one another from the first main body 118. The actuator assembly 106 also includes a second motor 126 and a second wedge plate 130 coupled to and driven linearly by the second motor 126. In the illustrated construction, each of the motors 110, 126 is a high-force electric cylinder, although other constructions include different types of motors. For example, in some constructions the motors 110, 126 are hydraulic cylinders or pneumatic cylinders. In the illustrated construction, the second wedge plate 130 includes a second main body 134 and five separate second arms 138 (FIGS. 7 and 8) that extend parallel to one another from the second main body 134. In other constructions the number of first and second arms 122, 138 is different than that illustrated.

Figure 8:
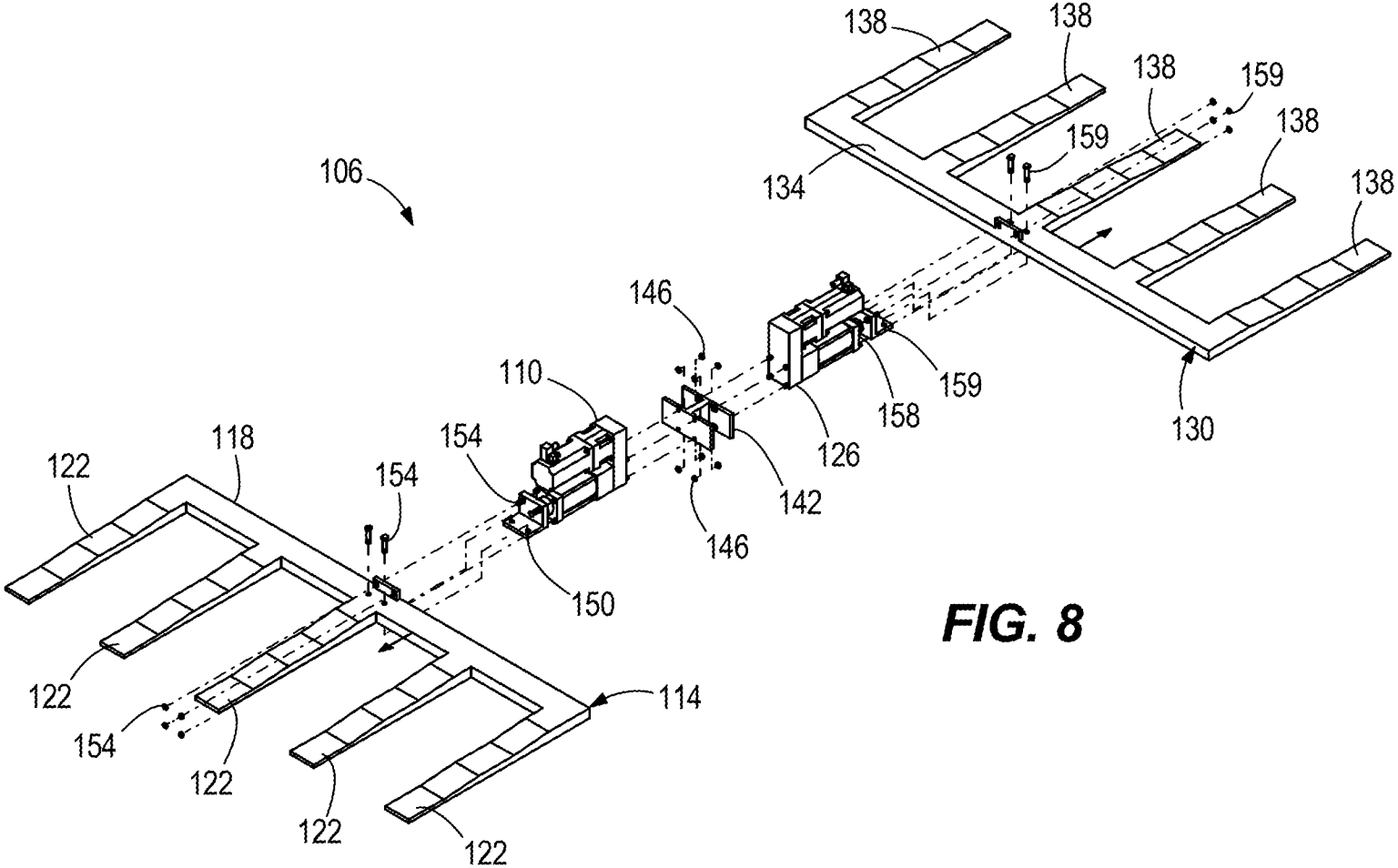
FIG. 8 is a perspective, exploded view of the actuator assembly.

With continued reference to FIGS. 7-12, the first and second motors 110, 126 drive the first wedge plate 114 and the second wedge plate 130 toward and away from one another in opposite directions. The first and second motors 110, 126 are coupled together with a thrust block 142 and thrust block bolts 146 (FIG. 8), such that the first and second motors 110, 126 are disposed between the first wedge plate 114 and the second wedge plate 130. As illustrated in FIG. 8, the first motor 110 is coupled to a first wedge connection plate 150, and the first wedge connection plate 150 is coupled to the first wedge plate 114, with first wedge connection bolts 154. The second motor 126 is coupled to a second wedge connection plate 158, and the second wedge connection plate 158 is coupled to the second wedge plate 130, with second wedge connection bolts 159.

Figure 23:
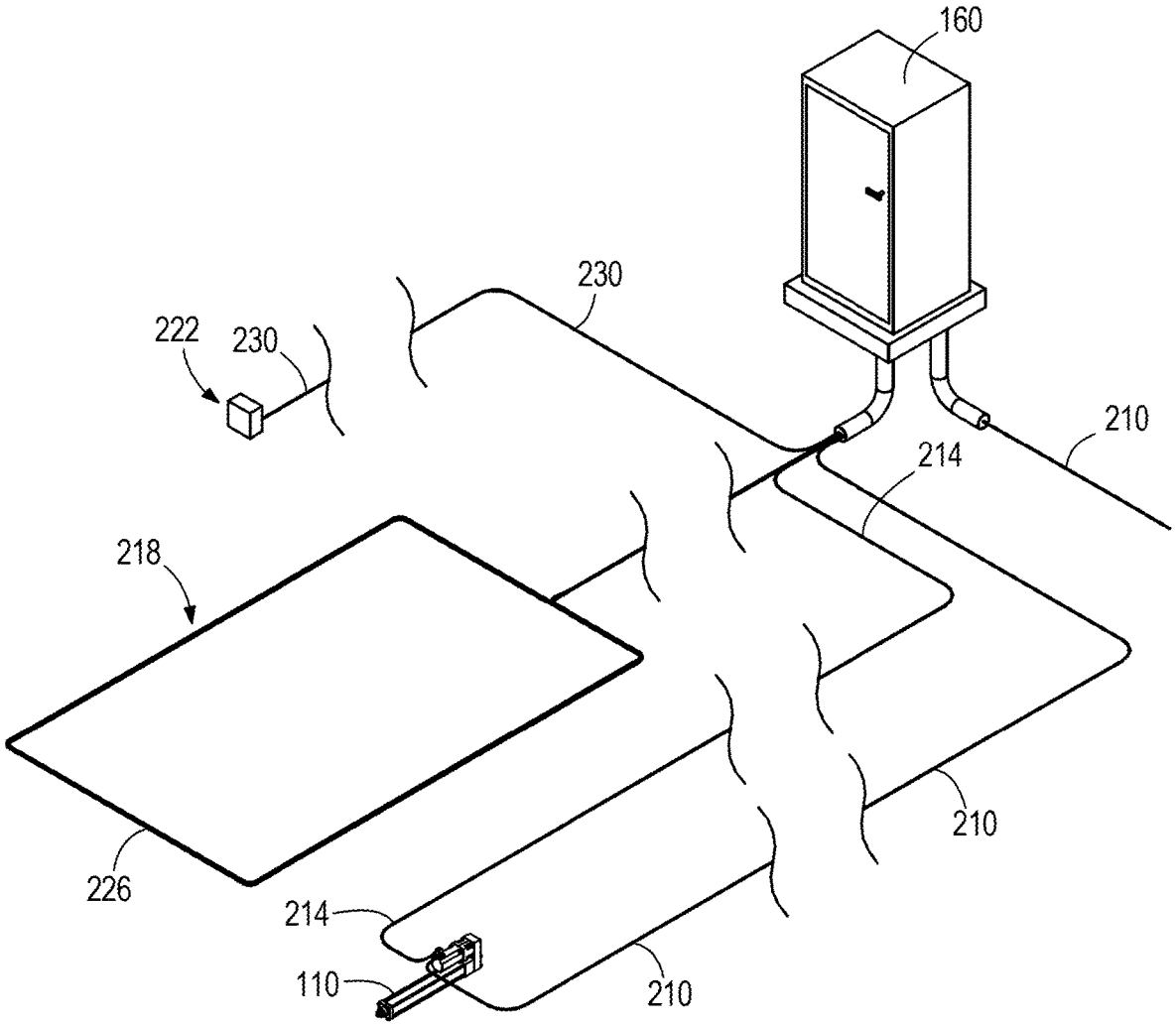
FIG. 23 is a schematic illustration of a wiring system for the automated rumble strip assembly.

With reference to FIGS. 7-12 and 23, the automated rumble strip assembly 10 further includes a controller 160 (FIG. 23) coupled to the actuator assembly 106. In the illustrated construction the controller 160 is coupled to both the first motor 110 and the second motor 126 (although only the first motor 110 is shown in FIG. 23), and controls operation of the first and second motors 110, 126. In some constructions the controller 160 communicates wirelessly with the first and second motors 110, 126. In some constructions the controller 160 is disposed remotely from the actuator assembly 106 and from the frame 14.

With continued reference to FIGS. 7-12, when the first and second motors 110, 126 are actuated via the controller 160 in a first manner, the first and second wedge plates 114, 130 move linearly toward one another and toward the first and second motors 110, 126, thereby moving the plurality of elongate members 62 from the first position (FIGS. 10A, 10B) to the second position (FIGS. 11A, 11B), where the elongate members 62 are recessed. When the first and second motors 110, 126 are actuated via the controller 160 in a second manner, the first and second wedge plates 114, 130 move linearly away from one another and away from the first and second motors 110, 126, thereby moving the plurality of elongate members 62 from the second position (FIGS. 11A, 11B) back to the first position (FIGS. 12A, 12B), where the elongate members 62 are raised.

Figure 9:
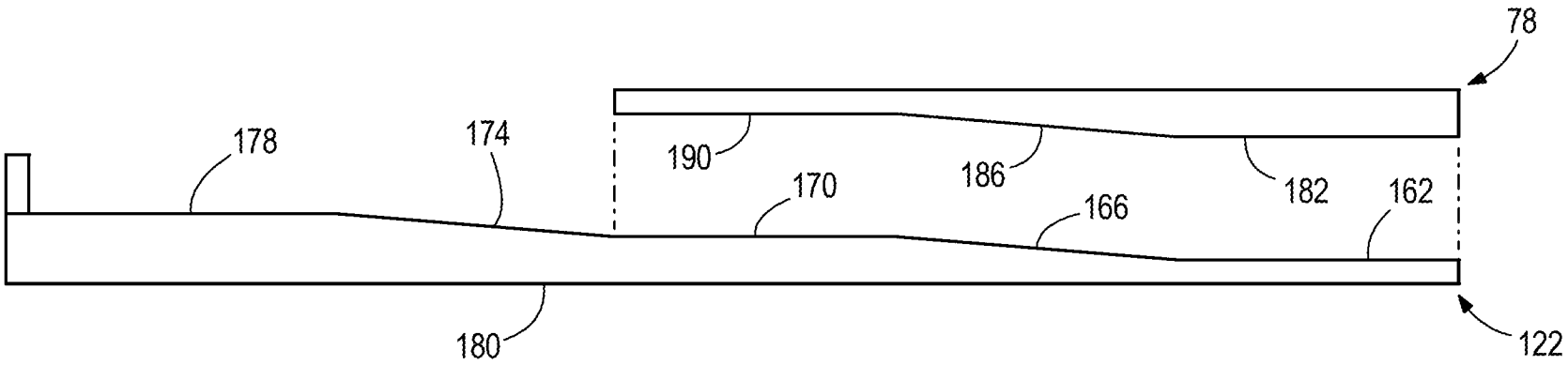
FIG. 9 is a side view of a portion of both the actuator assembly and the elongate member of FIG. 4.
Figure 10A:
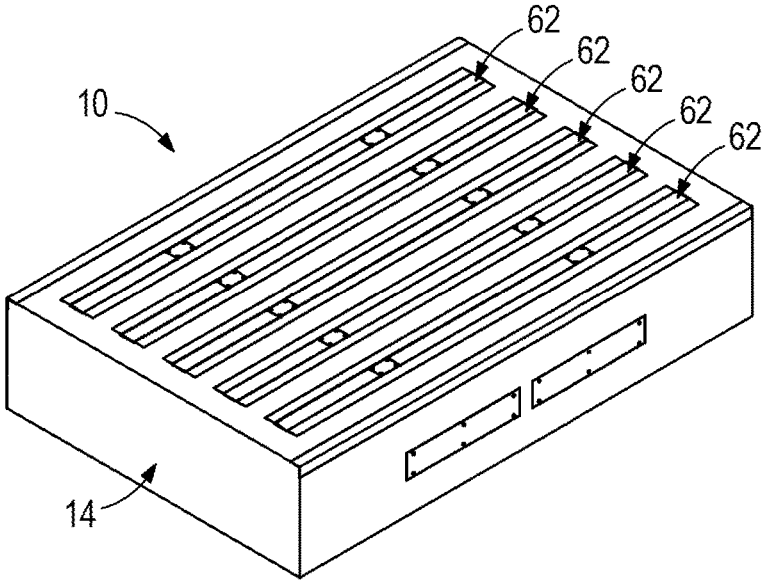
FIGS. 10A and 10B illustrate a first, initial raised position of the elongate members.
Figure 10B:
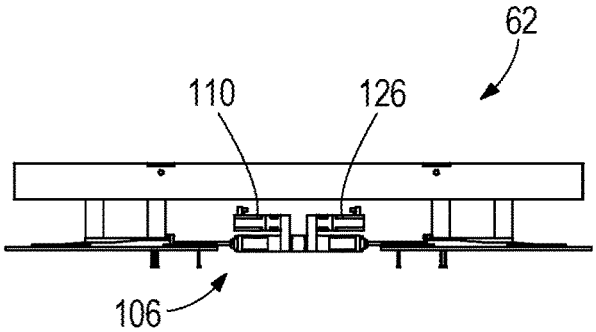
Figure 11A:
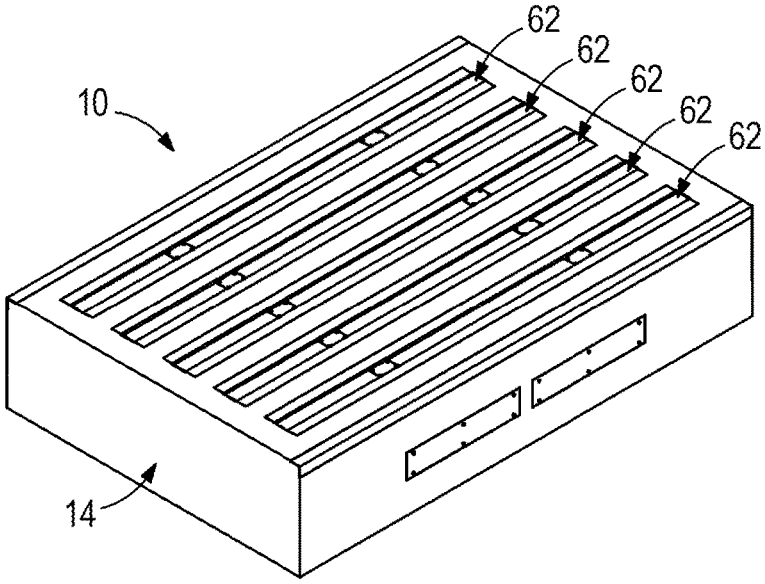
FIGS. 11A and 11B illustrate a second, lowered position of the elongate members, based on a first activation of the actuator assembly.
Figure 11B:
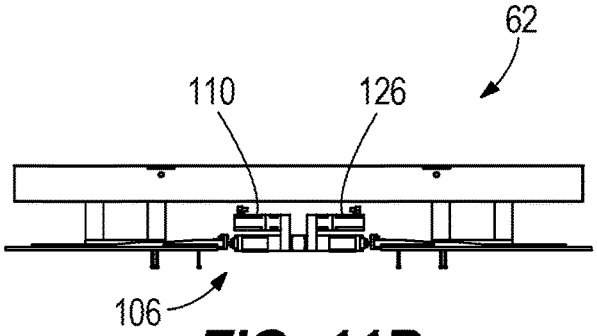
Figure 12A:
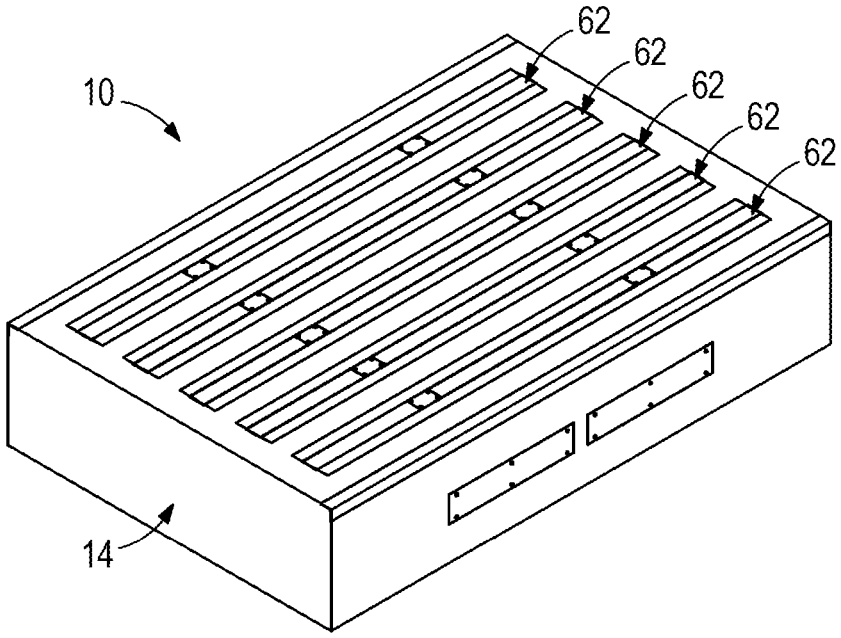
FIGS. 12A and 12B illustrate a third, raised position of the elongate member, based on a second activation of the actuator assembly.
Figure 12B:
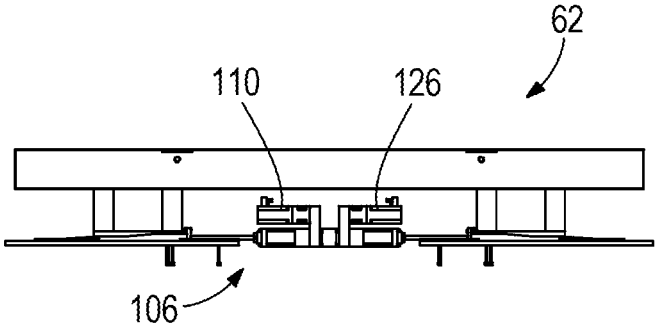
Figure 13:
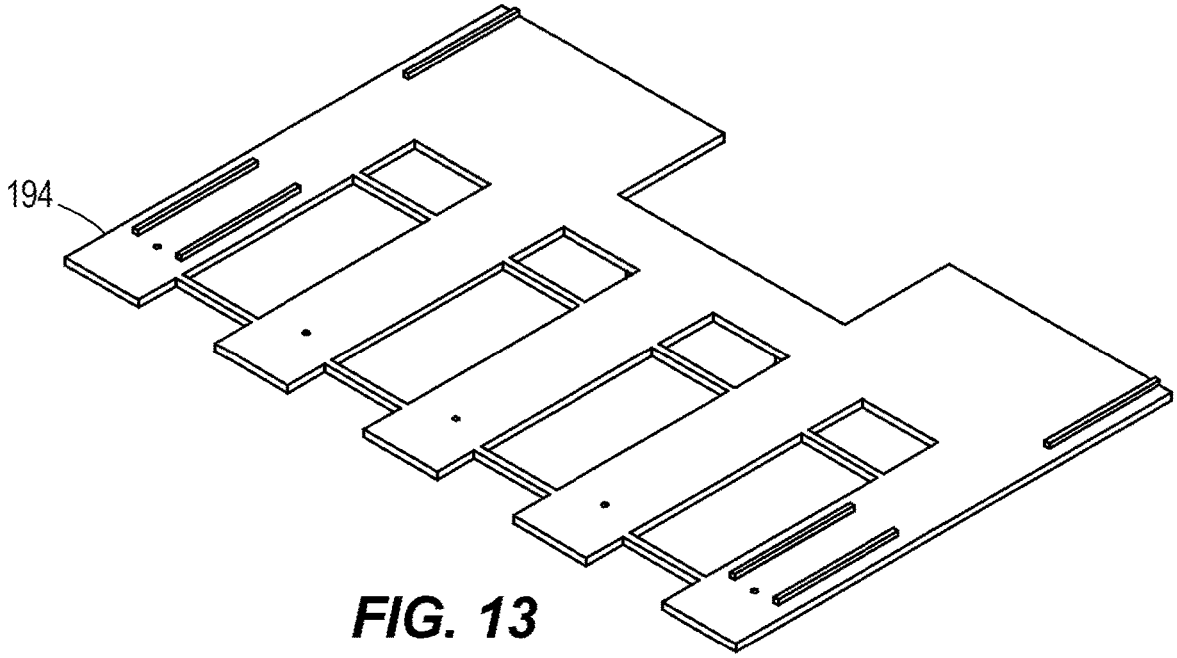
FIGS. 13 and 14 are perspective views of a lower plate of the automated rumble strip assembly.
Figure 14:
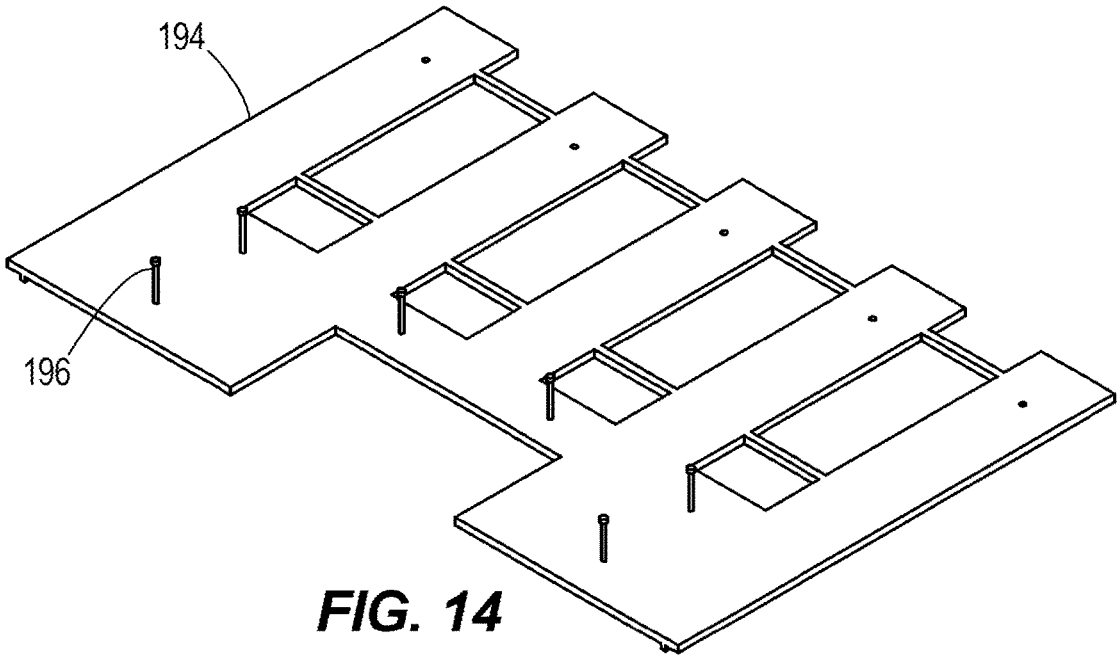

With reference to FIG. 9, each of the first arms 122 (as well as the second arms 138) includes a first surface 162, a second surface 166, a third surface 170, a fourth surface 174, and a fifth surface 178. The first surface 162, the third surface 170, and the fifth surface 178 are parallel to one another and are parallel to the top surface of the frame 14 (e.g., to the top surfaces 56 or the top surface 20). The second surface 166 extends between the first surface 162 and the third surface 170, and is transverse to both the first surface 162 and the third surface 170. The fourth surface 174 extends between the third surface 170 and the fifth surface 178 and is transverse to both the third surface 170 and the fifth surface 178. Each of the first arms 122 (as well as the second arms 138) also includes a lower surface 180.

With continued reference to FIG. 9, each of the base portions 78 of the elongate members 62 includes a first engagement surface 182, a second engagement surface 186, and a third engagement surface 190. The first engagement surface 182 and the third engagement surface 190 are parallel to one another and are parallel to the top surface of the frame 14 (e.g., to the top surfaces 56 or the top surface 20). The second engagement surface 186 extends between the first engagement surface 182 and the third engagement surface 190 and is transverse to both the first engagement surface 182 and the third engagement surface 190.

With continued reference to FIG. 9, when one of the elongate members 62 is in the first position, the first engagement surface 182 of the base portion 78 is engaged with the third surface 170 of the first arm 122, the second engagement surface 186 of the base portion 78 is engaged with the fourth surface 174 of the first arm 122, and the third engagement surface 190 of the base portion 78 is engaged with the fifth surface 178 of the first arm 122.

With continued reference to FIG. 9, when the elongate member 62 is in the second position (e.g., recessed relative to the top surface of the frame 14), the first engagement surface 182 of the base portion 78 is engaged with the first surface 162 of the first arm 122, the second engagement surface 186 of the base portion 78 is engaged with the second surface 166 of the first arm 122, and the third engagement surface 190 of the base portion 78 is engaged with the third surface 170 of the first arm 122.

With continued reference to FIG. 9, in the illustrated construction when the elongate member 62 moves from the first position to the lowered second position (i.e., when the first arm 122 has moved to the position illustrated in FIG. 9), the first engagement surface 182 of the base portion 78 initially slides along the third surface 170 of the first arm 122, and the third engagement surface 190 of the base portion 78 slides along the fifth surface 178 of the first arm 122. The second engagement surface 186 of the base portion 78 slides along the second surface 166 of the first arm 122 until the first engagement surface 182 of the base portion 78 is engaged with the first surface 162 of the first arm 122 and the second engagement surface 186 of the base portion 78 is engaged with the second surface 166 of the first arm 122 and the third engagement surface 190 of the base portion 78 is engaged with the third surface 170 of the first arm 122.

While only a single base portion 78 and a single first arm 122 are illustrated in FIG. 9, the same arrangement and sliding movement described above simultaneously occurs at each of the other base portions 78 and each of the other first and second arms 122, 138 during operation. That is, when the first and second motors 110, 126 are actuated, the elongate members 62 move in unison, and the base portions 78 of the elongate members 62 slide together relative to the first and second arms 122, 138. This arrangement results in a smooth, consistent movement of the elongate members 62 between the first position and the second position, and also from the second position back to the first position.

With reference to FIGS. 2, 7, 13, 14, and 17-19 in the illustrated construction the automated rumble strip assembly 10 also includes lower plates 194. The lower plates 194 are disposed within the main housing 18 of the frame 14, and are positioned below the first and second wedge plates 114, 130. The lower plates 194 are coupled to the main housing 18 with welded studs 196. The lower plates 194 provide added stability and guidance for the first and second wedge plates 114, 130 and for the actuator assembly 106. For example, in some constructions the lower surfaces 180 of the first and second arms 122, 138 slide along the lower plates 194. In some constructions the lower plates 194 are not provided.

Figure 18:
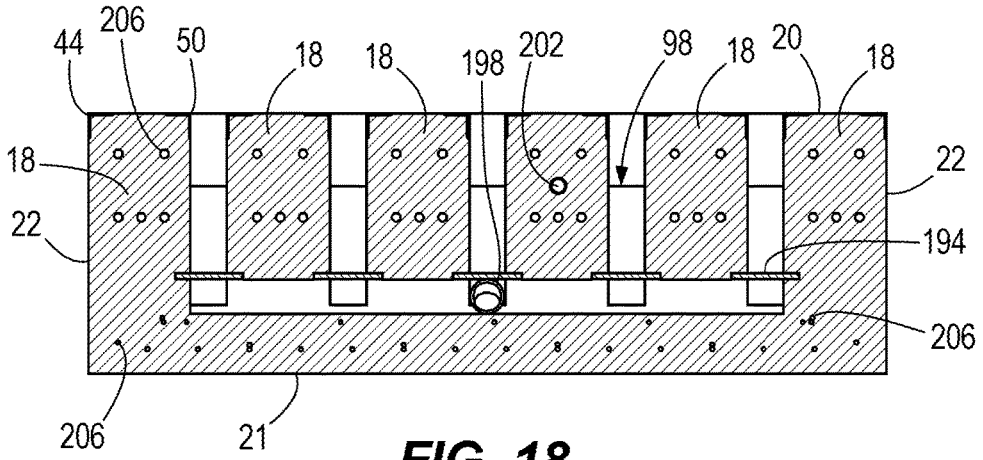
FIG. 18 is a cross-sectional view of the automated rumble strip assembly, taken along lines 18-18 in FIG. 15.
Figure 19:
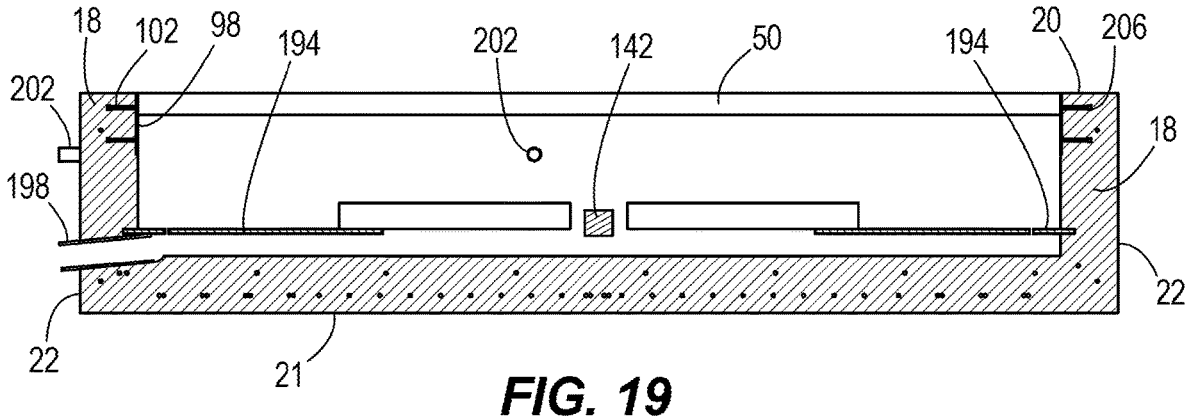
FIG. 19 is a cross-sectional view of the automated rumble strip assembly, taken along lines 19-19 in FIG. 15.
Figure 20:
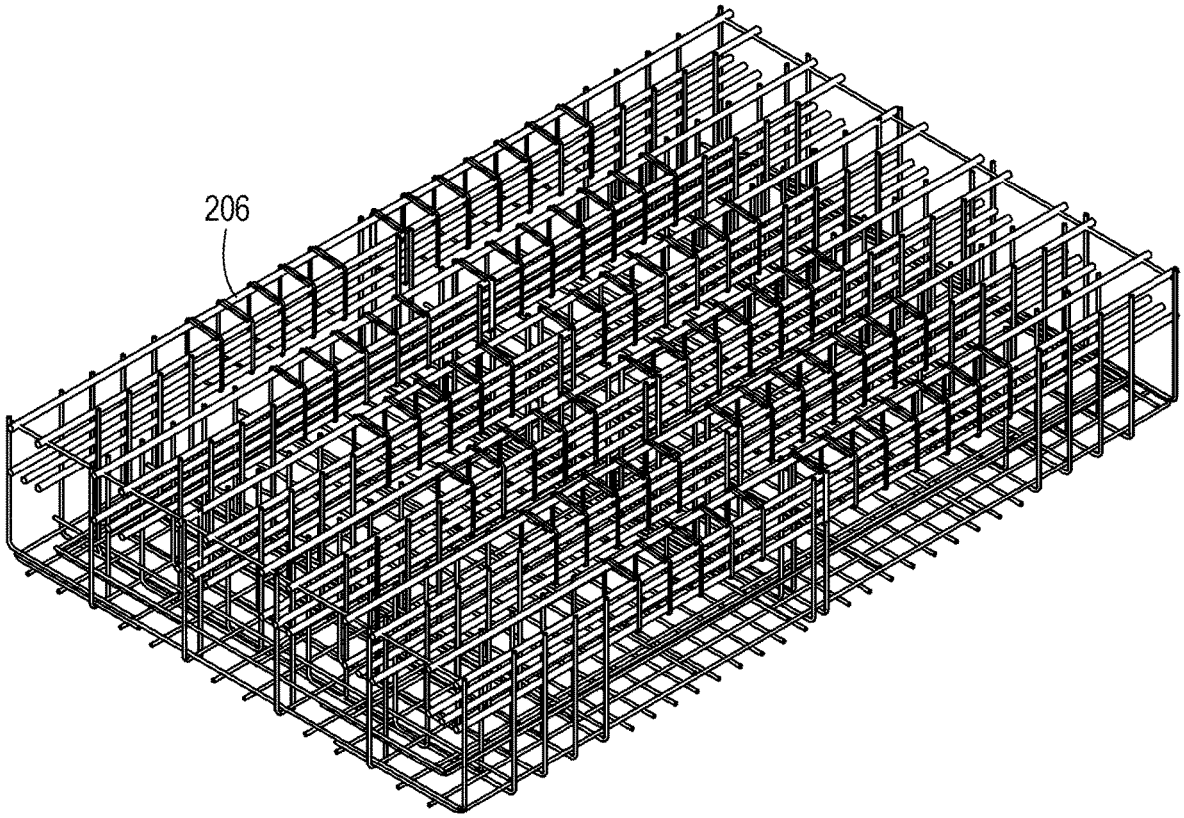
FIGS. 20-22 are perspective, front, and side views respectively of reinforcing elements of the automated rumble strip assembly.
Figure 21:
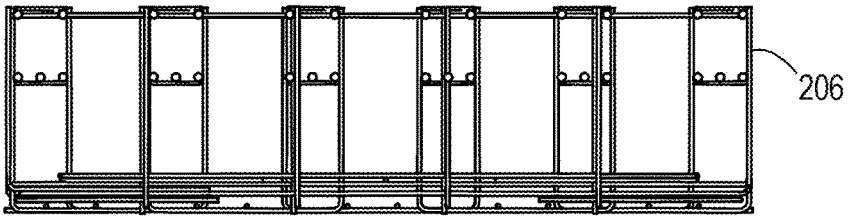
Figure 22:
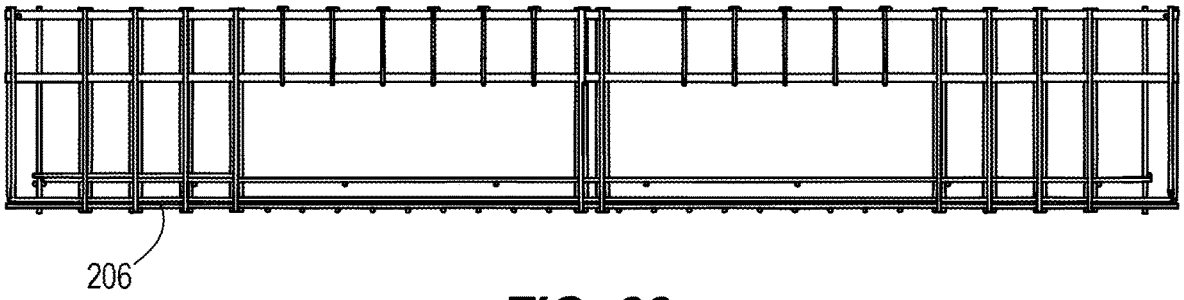

With reference to FIGS. 18 and 19, in the illustrated construction the automated rumble strip assembly 10 also includes a drain pipe 198 disposed below the lower plates 194. The drain pipe 198 permits water or other material to pass out of the frame 14.

Figure 17:
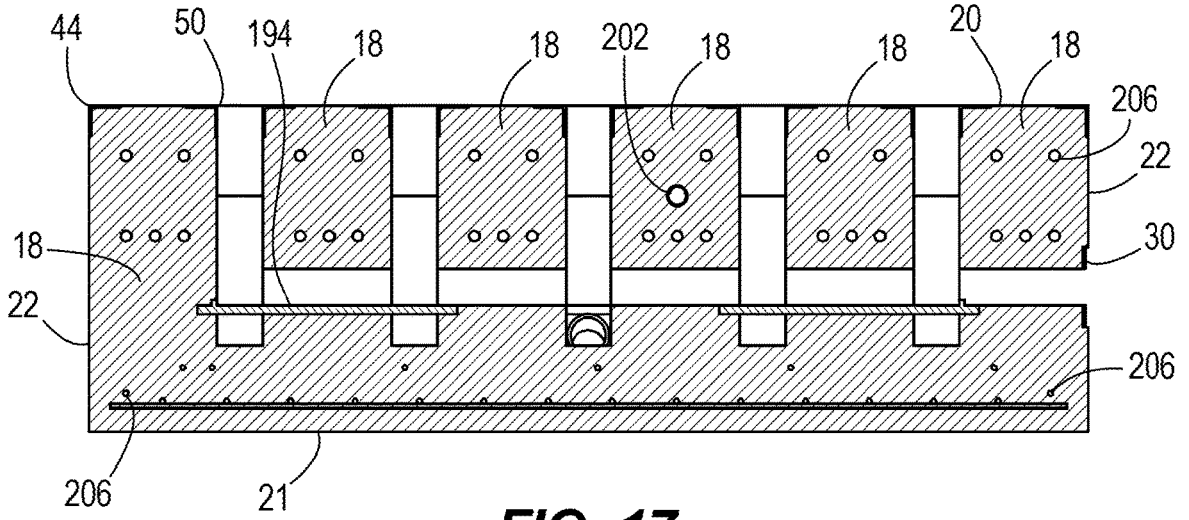
FIG. 17 is a cross-sectional view of the automated rumble strip assembly, taken along lines 17-17 in FIG. 15.

With reference to FIGS. 17-19, in the illustrated construction the automated rumble strip assembly 10 also includes at least one electrical conduit 202. In some constructions, the electrical conduit or conduits 202 provide space in the frame 14 for electricity and/or control signals to be delivered to the first and second motors 110, 126.

With reference to FIGS. 16-22, in the illustrated construction the automated rumble strip assembly 10 also includes a plurality of reinforcing elements 206. The reinforcing elements 206 provide added structural stability to the frame 14 and to the overall automated rumble strip assembly 10. In some constructions the reinforcing elements 206 are steel rebar elements, although other constructions include different materials or arrangements of reinforcing elements 206 than that illustrated.

With reference to FIG. 23, in the illustrated construction the controller 160 is coupled to each of the motors 110, 126 through one or more power cables 210 and control cables 214, and controls operation of the motors 110, 126. With reference to FIGS. 2 and 23, the automated rumble strip assembly 10 also includes at least one object detector to detect the presence of an object (e.g., vehicle) on the automated rumble strip assembly 10. In the illustrated construction the automated rumble strip assembly 10 includes a first object detector 218 (FIGS. 2 and 23) and a second object detector 222 (FIG. 23). The first object detector 218 includes an inductive loop wire 226 that is coupled to the controller 160 and wraps around the elongate members 62 (FIG. 2) inside of the frame 14. The second object detector 222 is a load cell that is coupled to the controller 160 with a cable 230. In other constructions a different number, arrangement, and/or type of object detector are provided. For example, in some constructions the object detector(s) is one of a piezoelectric wire, a camera detector, an infrared detector, a probe sensor, or an ultrasonic sensor.

With reference to FIG. 23, in the illustrated construction the controller 160 is configured to activate the motors 110, 126 and move the elongate members 62 from the first position to the second position only when the object detector detects that a vehicle is not positioned on the frame 14. This ensures that the automated rumble strip assembly 10 does not waste energy or movement, and is only used when a vehicle or vehicles are passing over the automated rumble strip assembly 10. In some constructions the controller 160 is configured to specifically detect pedestrians, trains, cars, or other specific objects (e.g., based on measurements or signals received from the object detector(s)), depending on how and where the automated rumble strip 10 is being used. For example, in some constructions the automated rumble strip assembly 10 is used at railroad crossings to raise driver awareness. In some constructions when the object detector senses an object, it sends a signal (e.g., through the cable 230) to the controller 160. The controller 160 then sends a signal through the control cable(s) 214 to the motors 110, 126 to retract the elongate members 62 (i.e., to move the elongate members 62 to the second position), causing rumbles to be formed in the roadway. In some constructions this action is controlled by a timer in the controller 160. For example, in some constructions the motors 110, 126 are activated based on timing, such as in school zones, where it is advantageous to have the elongate members 62 lowered (and rumbles thus formed in the roadway) during times of heavy pedestrian traffic or anticipated heavy pedestrian traffic in the school zones. Once the rumbles are no longer needed, based on time or object detection, the controller 160 checks the object detector to insure there are no vehicles on the automated rumble assembly 10. If no vehicles are detected, the controller 160 then sends a signal through the control cable(s) 214 to the motors 110, 126 to raise the elongate members 62 back to the first position, creating a generally smooth/flat roadway configuration.

FIGS. 24-40 illustrate another automated rumble strip assembly 1010. Similar to the automated rumble strip assembly 10, the automated rumble strip assembly 1010 may be used to raise a level of driver attention on roadways, and to facilitate a reduction in a number and/or severity of crashes. In some constructions, the automated rumble strip assembly 1010 is sized and shaped to be integrally formed as part of a newly constructed roadway. In other constructions, the rumble strip assembly 1010 is sized and shaped so as to be a retrofit for an existing roadway.

Figure 24:
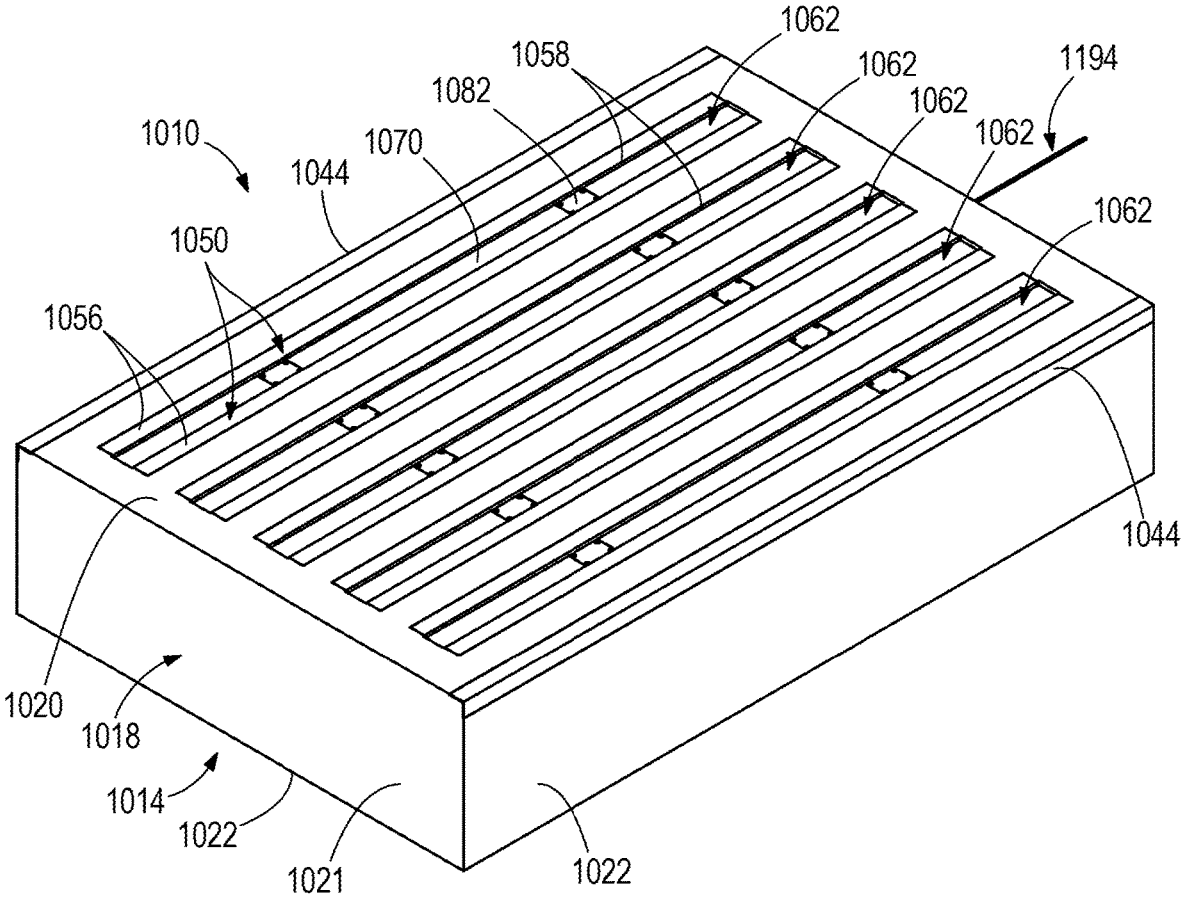
FIG. 24 is a perspective view of an automated rumble strip assembly according to another embodiment.
Figure 25:
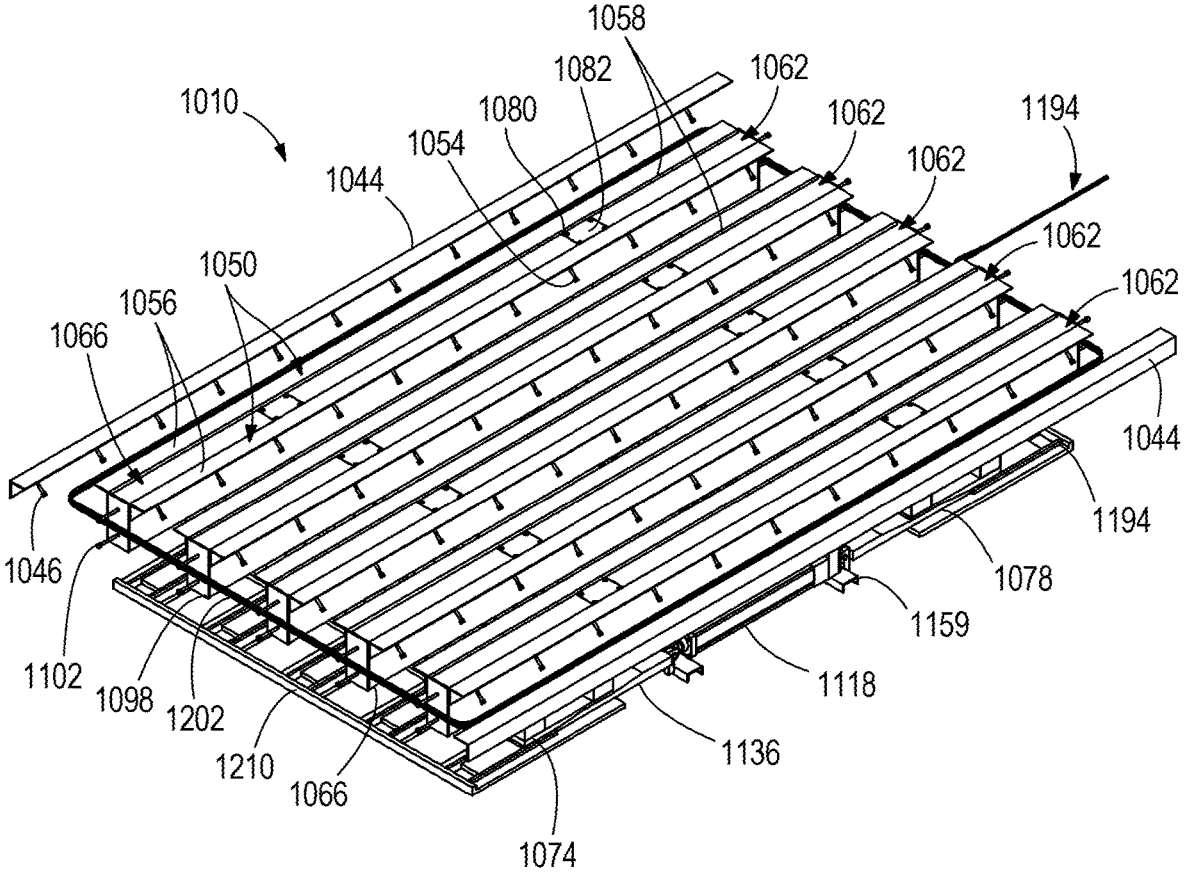
FIG. 25 is a perspective view of the automated rumble strip assembly of FIG. 24, with a frame removed.

With reference to FIGS. 24 and 25, the automated rumble strip assembly 1010 includes a frame 1014. The frame 1014 is a generally box-like structure. In other constructions the frame 1014 has other shapes and/or sizes than that illustrated. The frame 1014 includes a main housing 1018 having a top surface 1020 (e.g., a planar top surface), a bottom surface 1021, and at least one side surface 1022 that extends (e.g., perpendicularly and downwardly) from the top surface 1020. In the illustrated construction the main housing 1018 is made of concrete, although in other constructions the main housing 1018 is made of material other than concrete. In the illustrated construction the frame 1014 does not include access assemblies. However, in some constructions the frame 1014 includes one or more access assemblies such as the access assemblies 26 described above for frame 14.

With continued reference to FIGS. 24 and 25, the frame 1014 further includes edge plates 1044 that provide added structural stability to the automated rumble strip assembly 1010. Similar to the frame 14, the frame 1014 includes two edge plates 1044 that fit over opposite edges of the main housing 1018, and are coupled to the main housing 1018 with welded studs 1046. The edge plates 1044 each have a generally an L-shaped angled profile, with one portion of each of the L-shaped angled profiles contacting the top surface 1020 of the main housing 1018, and another portion contacting one of the side surfaces 1022. In some constructions, the frame 1014 includes a different number of edge plates 1044 than that illustrated, and/or includes edge plates 1044 having different shapes and/or sizes than that illustrated. In some constructions, the frame 1014 does not include any edge plates 1044.

With continued reference to FIGS. 24 and 25, the frame 1014 further includes guiding angle plates 1050 that provide added structural stability to the automated rumble strip assembly 1010. Similar to the frame 14, the frame 1014 includes five pairs of guiding angle plates 1050 that are each coupled to the top surface 1020 of the main housing 1018 with welded studs 1054 (FIG. 25), and extend parallel to one another along the top surface 1020. The guiding angle plates 1050 each include a top surface 1056 (e.g., a planar top surface). In some constructions, the frame 1014 includes a different number of guiding angle plates 1050 than that illustrated, and/or includes guiding angle plates 1050 having different shapes and/or sizes than that illustrated. In some constructions, the frame 1014 does not include any guiding angle plates 1050.

Figure 34:
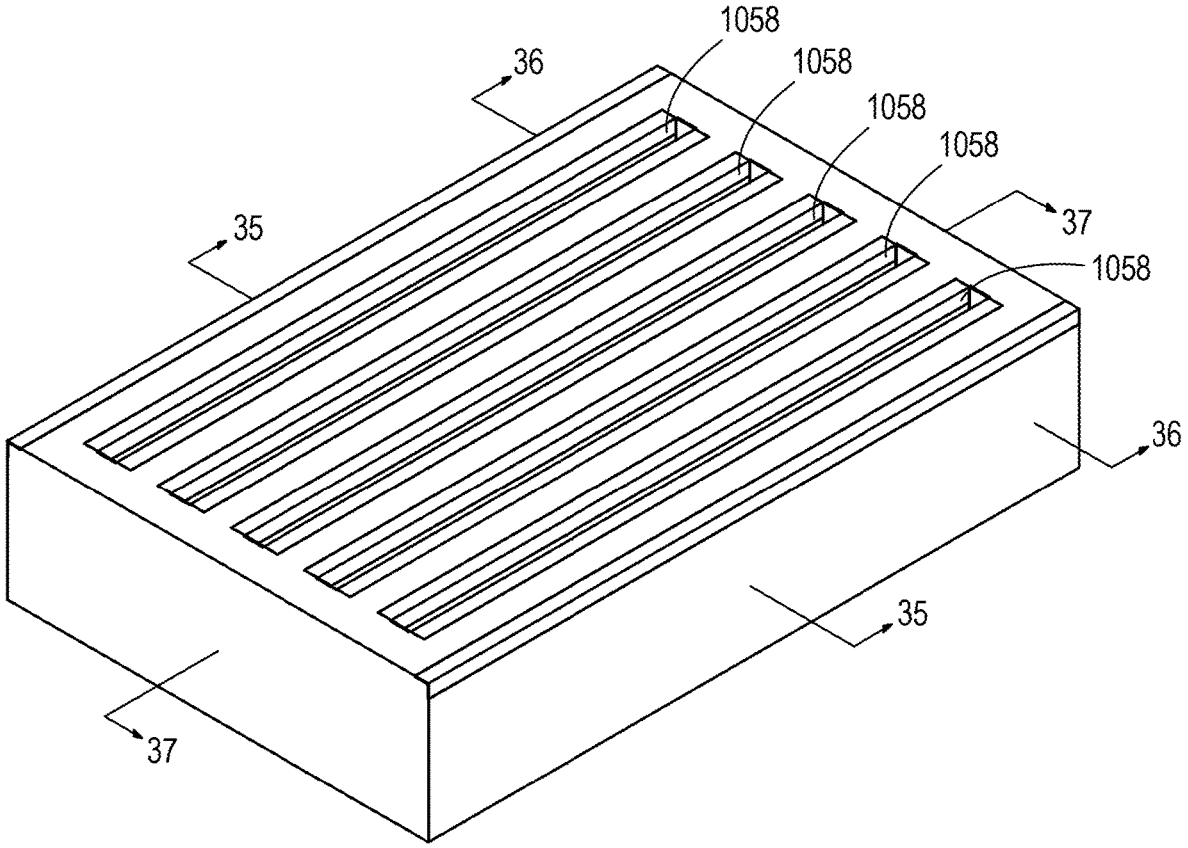
FIG. 34 is a perspective view of the automated rumble strip assembly of FIG. 23, with the elongate members removed.

With reference to FIGS. 24 and 34, the frame 1014 also includes a plurality of elongate apertures 1058 that are open and exposed along the top surface 1020 of the main housing 1018. Similar to the apertures 58 in the frame 14, each of the elongate apertures 1058 in the frame 1014 is positioned between a pair of the guiding angle plates 1050, and extends parallel to each of the other elongate apertures 1058.

With reference to FIGS. 24-28, the automated rumble strip assembly 1010 also includes a plurality of movable, elongate members 1062 that are disposed at least partially within the frame 1014. The automated rumble strip assembly 1010 includes five elongate members 1062 that are spaced equally apart from one another and are parallel to one another. However, in other constructions the number and/or arrangement of elongate members 1062 is different.

Figure 26:
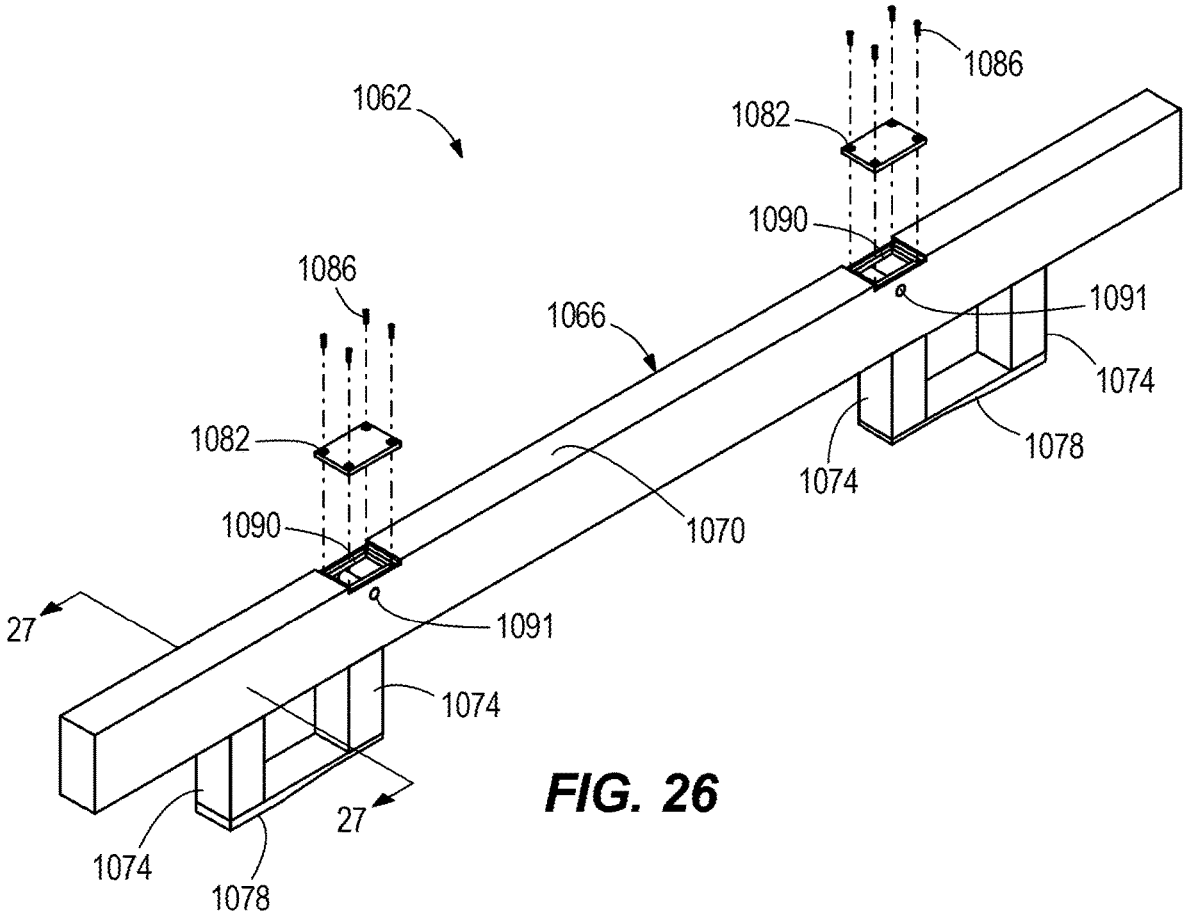
FIG. 26 is a perspective, exploded view of an elongate member of the automated rumble strip assembly of FIG. 24.

With reference to FIG. 26, similar to the elongate members 62, each of the elongate members 1062 includes an upper body 1066. Each of the upper bodies 1066 is generally rectangular in cross-section, and includes a top surface 1070. In the illustrated construction, each of upper bodies 1066 is sized and shaped to move within one of the elongate apertures 1058 (e.g., along the direction of the arrows in FIG. 24).

With continued reference to FIG. 26, each of the elongate members 1062 also includes at least one support member 1074 coupled to and extending beneath the upper body 1066. The support members 1074 support the upper body 1066. In the illustrated construction, each of the elongate members 1062 includes four support members 1074 extending perpendicularly below the upper body 1066. In other constructions, the elongate members 1062 include a different number and/or arrangement of support members 1074.

With continued reference to FIG. 26, each of the elongate members 1062 also includes at least one base portion 1078 that is coupled to and disposed below the support members 1074. In the illustrated construction, each of the elongate members 1062 includes two base portions 1078. Each of the base portions 1078 is coupled to two of the support members 1074. In other constructions, the elongate members 1062 include a different number and/or arrangement of base portions 1078.

With continued reference to FIG. 26, each of the elongate members 1062 also includes at least one elongate member access plate 1082 that is coupled to the upper body 1066 with bolts 1086. When the access plate 1082 is removed, an access plate frame 1090 and a lifting rod 1091 are exposed inside of the upper body 1066. In some constructions, the lifting rod 1091 may be used to lift and/or move the elongate member 1062. While the illustrated construction includes two access plates 1082, other constructions include different numbers of access plates 1082 than that illustrated. In some constructions, the elongate members 1062 do not include any access plates 1082, access plate frames 1090, and/or lifting rods 1091. In some constructions, the access plates 1082 are located along a different surface of the elongate member 1062 than that illustrated.

Figure 27:
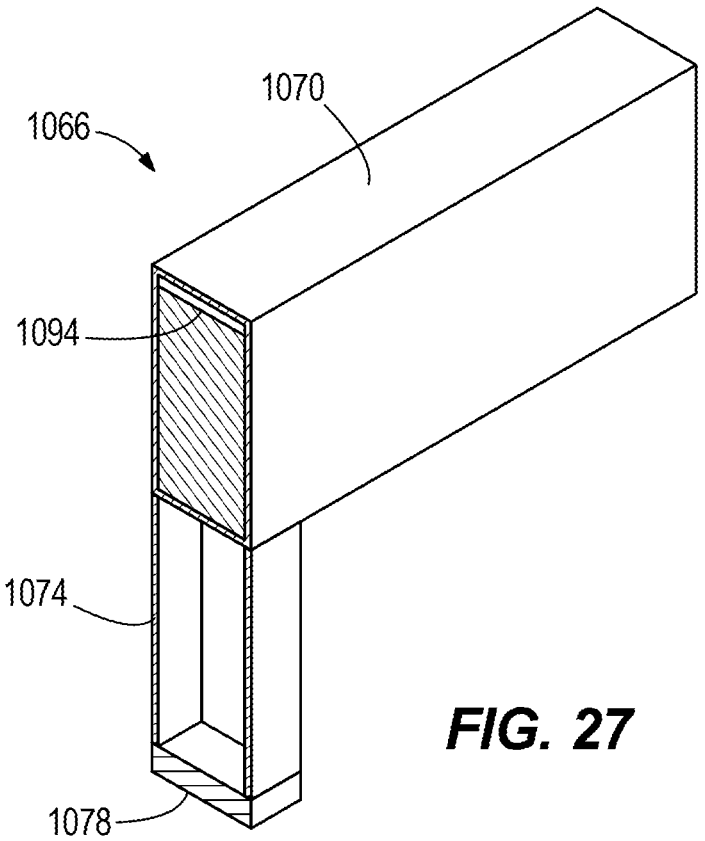
FIG. 27 is a cross-sectional view of the elongate member, taken through lines 27-27 in FIG. 26.

With reference to FIG. 27, each elongate member 1062 also includes a dampening material 1094 disposed within the upper body 1066. The dampening material 1094 at least partially fills an interior, hollow space in the upper body 1066, and acts to dampen sound and/or vibrations as a vehicle travels over the automated rumble strip assembly 1010. In some constructions, the dampening material 1094 is sand or liquid such as water or oil, although other constructions include different materials. In some constructions, the upper body 1066 does not include any dampening material.

Figure 28:
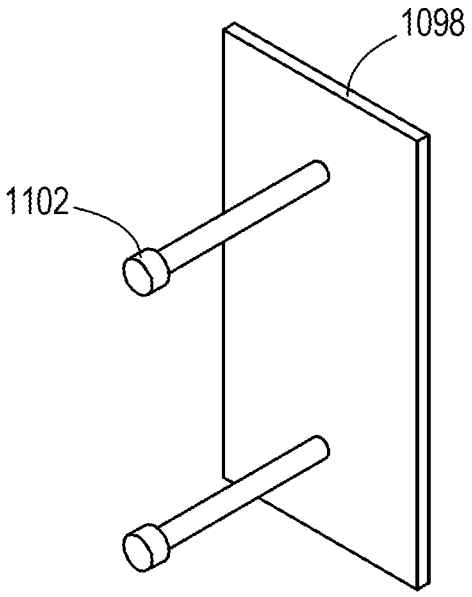
FIG. 28 is a perspective view of an end plate of the automated rumble strip assembly of FIG. 24.

With reference to FIGS. 24 and 28, the automated rumble strip assembly 1010 also includes end plates 1098 that are coupled to the main body 1018, to provide added structural stability to the automated rumble strip assembly 1010 and guidance for the elongate members 1062. In the illustrated construction, the end plates 1098 are coupled to the main body 1018 with welded studs 1102. In some constructions the automated rumble strip assembly 1010 does not include end plates 1098.

With reference to FIGS. 29-32, the rumble strip assembly 1010 also includes an actuator assembly 1106. In the illustrated construction the actuator assembly 1106 is disposed entirely within the main housing 1018 of the frame 1014. However, in other construction at least a portion of the actuator assembly 1106 is disposed outside of the main housing 1018. The actuator assembly 1106 moves the elongate members 1062 from a first position where each of the top surfaces 1070 (FIGS. 26 and 27) of the elongate members 1062 is at a first distance relative to a top surface of the frame 1014, to a second position where each of the top surfaces 1070 of the elongate members 1062 is at a second, different distance relative to the top surface of the frame 1014. In the illustrated construction, the top surface of the frame 1014 corresponds to the top surfaces 1056 of the guiding angle plates 1050. In other constructions, the top surface of the frame 1014 corresponds to the top surface 1020 of the main housing 1018. In the illustrated construction, each of the top surfaces 1070 is flush relative to the top surface of the frame 1014 in the first position, and is recessed relative to the top surface of the frame 1014 in the second position.

Figure 29:
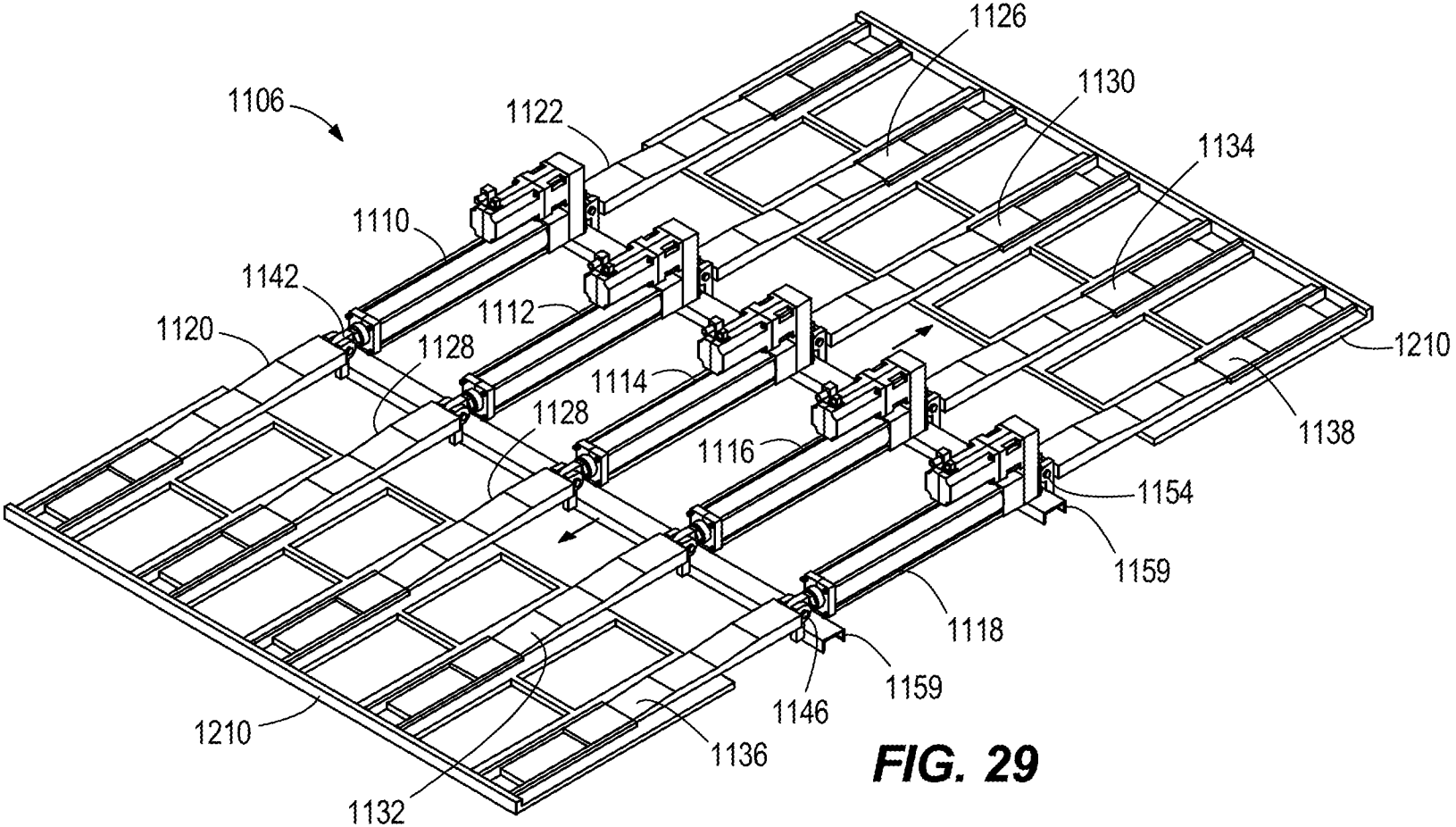
FIG. 29 is a perspective view of an actuator assembly of the automated rumble strip assembly of FIG. 24.

With continued reference to FIGS. 29-32, the actuator assembly 1106 includes a first motor 1110, a second motor 1112, a third motor 1114, a fourth motor 1116, and a fifth motor 1118. In the illustrated construction, each of the motors 1110, 1112, 1114, 1116, and 1118 is a high-force electric cylinder, although other constructions include different types of motors. For example, in some constructions the motors 1110, 1112, 1114, 1116, and 1118 are hydraulic cylinders or pneumatic cylinders. As illustrated in FIG. 29, the motors 1110, 1112, 1114, 1116, and 1118 are parallel to one another and spaced equally apart from one another. A first wedge plate 1120 and a second wedge plate 1122 are coupled to and driven linearly by the first motor 1110, in opposite directions from one another. A third wedge plate 1124 and a fourth wedge plate 1126 are coupled to and driven linearly by the second motor 1112, in opposite directions from one another. A fifth wedge plate 1128 and a sixth wedge plate 1130 are coupled to and driven linearly by the third motor 1114, in opposite direction from one another. A seventh wedge plate 1132 and an eighth wedge plate 1134 are coupled to and driven linearly by the fourth motor 1116, in opposite directions from one another. A ninth wedge plate 1136 and a tenth wedge plate 1138 are coupled to and driven linearly by the fifth motor 1118, in opposite direction from one another.

Figure 30:
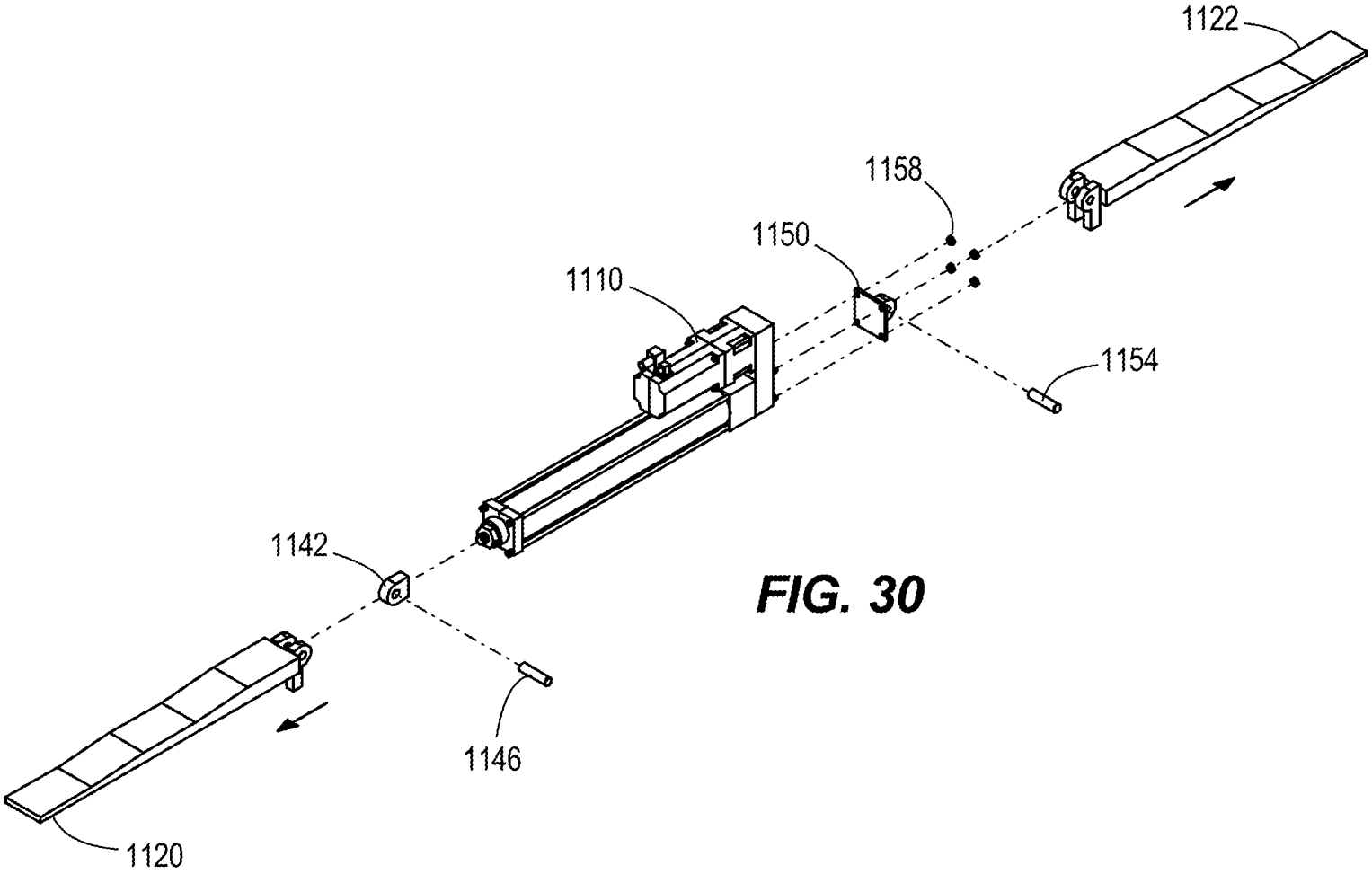
FIG. 30 is a perspective, exploded view of the actuator assembly of FIG. 29.

With reference to FIG. 30, in the illustrated construction each of the motors 1110, 1112, 1114, 1116, 1118 is coupled to its respective wedge plates 1120, 1122, 1124, 1126, 1128, 1130, 1132, 1134, 1136, 1138 with a rod clevis 1142, a first connection pin 1146, a clevis bracket 1150, a second connection pin 1154, and ram nuts 1158. In the illustrated construction the actuator assembly 1106 also includes wedge stops 1159 (e.g., coupled to the frame 1014) that limit movement of the wedge plates 1120, 1122, 1124, 1126, 1128, 1130, 1132, 1134, 1136, 1138.

Figure 32:
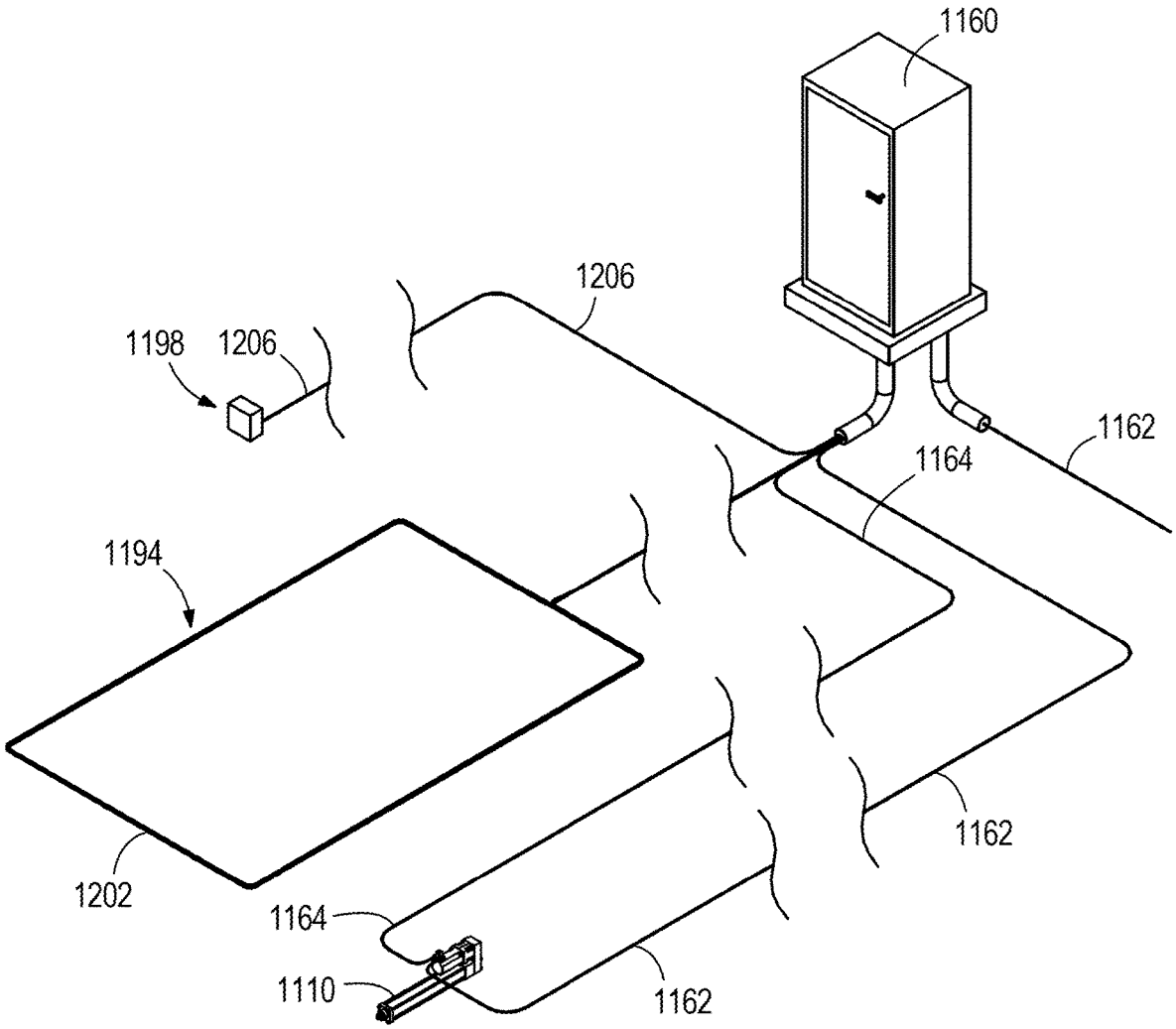
FIG. 32 is a schematic illustration of a wiring system for the automated rumble strip assembly of FIG. 24.
Figure 33:
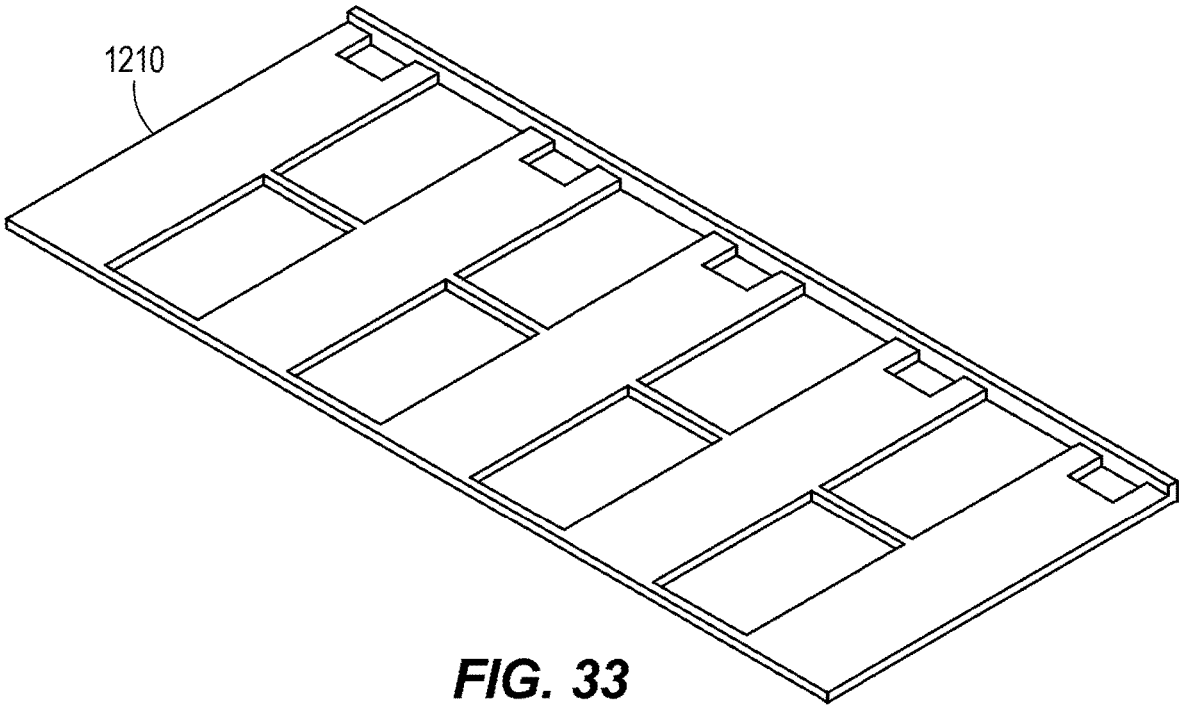
FIG. 33 is a perspective view of a lower plate of the automated rumble strip assembly of FIG. 24.

With reference to FIG. 32, the automated rumble strip assembly 1010 further includes a controller 1160 coupled to the actuator assembly 1106. In the illustrated construction the controller 1160 is coupled to each of the first motor 1110, the second motor 1112, the third motor 1114, the fourth motor 1116, and the fifth motor 1118 (although only the first motor 1110 is shown) through one or more power cables 1162 and control cables 1164, and controls operation of the motors 1110, 1112, 1114, 1116, 1118. In some constructions the controller 1160 communicates wirelessly with the motors 1110, 1112, 1114, 1116, 1118. In some constructions the controller 1160 is disposed remotely from the actuator assembly 1106 and from the frame 1114.

When the motors 1110, 1112, 1114, 1116, 1118 are actuated via the controller 1160 in a first manner, the first wedge plate 1120, the third wedge plate 1124, the fifth wedge plate 1128, the seventh wedge plate 1132, and the ninth wedge plate 1136 move linearly toward the motors 1110, 1112, 1114, 1116, 1118 along a first direction, and the second wedge plate 1122, the fourth wedge plate 1126, the sixth wedge plate 1130, the eighth wedge plate 1134, and the tenth wedge plate 1138 move linearly toward the motors 1110, 1112, 1114, 1116, 1118 along a second, opposite direction, thereby moving the plurality of elongate members 1062 from the first position to the second position (e.g., similar to what is shown in FIGS. 10A, 10B, 11A, and 11B). When the motors 1110, 1112, 1114, 1116, 1118 are actuated via the controller 1160 in a second manner, the first wedge plate 1120, the third wedge plate 1124, the fifth wedge plate 1128, the seventh wedge plate 1132, and the ninth wedge plate 1136 move linearly away the motors 1110, 1112, 1114, 1116, 1118 along a first direction, and the second wedge plate 1122, the fourth wedge plate 1126, the sixth wedge plate 1130, the eighth wedge plate 1134, and the tenth wedge plate 1138 move linearly away from the motors 1110, 1112, 1114, 1116, 1118 along a second, opposite direction, thereby moving the plurality of elongate members 1062 from the second position back to the first position (e.g., similar to what is shown in FIGS. 11A, 11B, 12A, and 12B).

Figure 31:
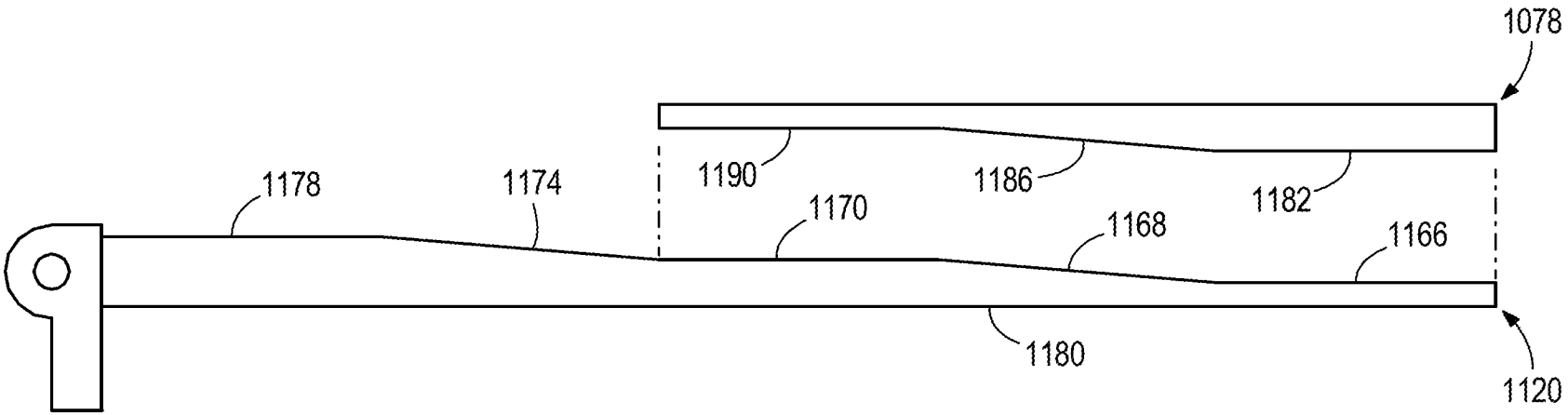
FIG. 31 is a side view of a portion of both the actuator assembly of FIG. 29 and the elongate member of FIG. 26.

With reference to FIG. 31, each of the wedge plates 1120, 1122, 1124, 1126, 1128, 1130, 1132, 1134, 1136, 1138 defines an arm that includes a first surface 1166, a second surface 1168, a third surface 1170, a fourth surface 1174, and a fifth surface 1178. The first surface 1166, the third surface 1170, and the fifth surface 1178 are parallel to one another and are parallel to the top surface of the frame 1014. The second surface 1168 extends between the first surface 1166 and the third surface 1170, and is transverse to both the first surface 1166 and the third surface 1170. The fourth surface 1174 extends between the third surface 1170 and the fifth surface 1178 and is transverse to both the third surface 1170 and the fifth surface 1178. Each of the wedge plates 1120, 1122, 1124, 1126, 1128, 1130, 1132, 1134, 1136, 1138 also includes a lower surface 1180.

With continued reference to FIG. 31, each of the base portions 1078 of the elongate members 1062 includes a first engagement surface 1182, a second engagement surface 1186, and a third engagement surface 1190. The first engagement surface 1182 and the third engagement surface 1190 are parallel to one another and are parallel to the top surface of the frame 1014. The second engagement surface 1186 extends between the first engagement surface 1182 and the third engagement surface 1190 and is transverse to both the first engagement surface 1182 and the third engagement surface 1190.

With continued reference to FIG. 31, when one of the elongate members 1062 is in the first position, the first engagement surface 1182 of one of the base portions 1078 is engaged with the third surface 1170, the second engagement surface 1186 of the base portion 1078 is engaged with the fourth surface 1174, and third engagement surface 1190 of the base portion 1078 is engaged with the fifth surface 1178.

With continued reference to FIG. 31, when the elongate member 1062 is in the second position, the first engagement surface 1182 of the base portion 1078 is engaged with the first surface 1166, the second engagement surface 1186 of the base portion 1078 is engaged with the second surface 1168, and the third engagement surface 1190 of the base portion 1078 is engaged with the third surface 1170.

With continued reference to FIG. 31, when the elongate member 1062 moves from the first position to the second position, the first engagement surface 1182 of the base portion 1078 initially slides along the third surface 1170, and the third engagement surface 190 of the base portion 1078 slides along the fifth surface 1178. The second engagement surface 1186 of the base portion 1078 slides along the second surface 1168 until the first engagement surface 1182 of the base portion 1078 is engaged with the first surface 1166 and the second engagement surface 1186 of the base portion 1078 is engaged with the second surface 1168 and the third engagement surface 1190 of the base portion 1078 is engaged with the third surface 1170.

While only a single base portion 1078 and a single wedge plate 1120 are illustrated in FIG. 9, the same arrangement and sliding movement described above simultaneously occurs at each of the other base portions 1078 and wedge plates 1122, 1124, 1126, 1128, 1130, 1132, 1134, 1136, 1138 during operation. That is, when the motors 1110, 1112, 1114, 1116, and 1118 are actuated, the elongate members 1062 move in unison, and the base portions 1078 of the elongate members 1062 slide together relative to the wedge plates 1122, 1124, 1126, 1128, 1130, 1132, 1134, 1136, 1138. This arrangement results in a smooth, consistent movement of the elongate members 1062 between the first position and the second position, and also from the second position back to the first position.

With reference to FIGS. 24, 25, and 32, the automated rumble strip assembly 1010 also includes at least one object detector to detect the presence of an object (e.g., vehicle) on the automated rumble strip assembly 1010. In the illustrated construction the automated rumble strip assembly 1010 includes a first object detector 1194 and a second object detector 1198. The first object detector 1194 includes an inductive loop wire 1202 that is coupled to the controller 1160 and wraps around the elongate members 1062 (FIG. 25) inside of the frame 1114. The second object detector 1198 (FIG. 32) is a load cell that is coupled to the controller 1160 with a cable 1206. In other constructions a different number, arrangement, and/or type of object detector are provided. For example, in some constructions the object detector(s) is one of a piezoelectric wire, a camera detector, an infrared detector, a probe sensor, or an ultrasonic sensor.

With continued reference to FIG. 32, in the illustrated construction the controller 1160 is configured to activate the motors 1110, 1112, 1114, 1116, 1118 and move the elongate members 1062 from the first position to the second position only when the object detector detects that a vehicle is not positioned on the frame 1014. This ensures that the automated rumble strip assembly 1010 does not waste energy or movement, and is only used when a vehicle or vehicles are passing over the automated rumble strip assembly 1010. In some constructions the controller 1160 is configured to specifically detect pedestrians, trains, cars, or other specific objects (e.g., based on measurements or signals received from the object detector(s)), depending on how and where the automated rumble strip assembly 1010 is being used. For example, in some constructions the automated rumble strip assembly 1010 is used at railroad crossings to raise driver awareness. In some constructions when the object detector senses an object, it sends a signal (e.g., through the cable 1206) to the controller 1160. The controller 1160 then sends a signal through the control cable(s) 1164 to the motors 1110, 1112, 1114, 1116, 1118 to retract the elongate members 1062 (i.e., to move the elongate members 1062 to the second position), causing rumbles to be formed in the roadway. In some constructions this action is controlled by a timer in the controller 1160. For example, in some constructions the motors 1110, 1112, 1114, 1116, 1118 are activated based on timing, such as in school zones, where it is advantageous to have the elongate members 1062 lowered (and rumbles thus formed in the roadway) during times of heavy pedestrian traffic or anticipated heavy pedestrian traffic in the school zones. Once the rumbles are no longer needed, based on time or object detection, the controller 1160 checks the object detector to insure there are no vehicles on the automated rumble assembly 1010. If no vehicles are detected, the controller 1160 then sends a signal through the control cable(s) 1164 to the motors 1110, 1112, 1114, 1116, 1118 to raise the elongate members 1062 back to the first position, creating a generally smooth/flat roadway configuration.

With reference to FIGS. 25, 29, 33, and 37, the automated rumble strip assembly 1010 also includes lower plates 1210. The lower plates 1210 are disposed within the main housing 1018 of the frame 1014, and are positioned below the wedge plates 1120, 1122, 1124, 1126, 1128, 1130, 1132, 1134, 1136, 1138. In some constructions the lower plates 1210 are coupled to the main housing 1018 with welded studs. The lower plates 1210 provide added stability and guidance for the wedge plates 1120, 1122, 1124, 1126, 1128, 1130, 1132, 1134, 1136, 1138 and for the actuator assembly 1106. For example, in some constructions the lower surfaces 1180 of the wedge plates 1120, 1122, 1124, 1126, 1128, 1130, 1132, 1134, 1136, 1138 slide along the lower plates 1210. In some constructions the lower plates 1210 are not provided.

Figure 36:
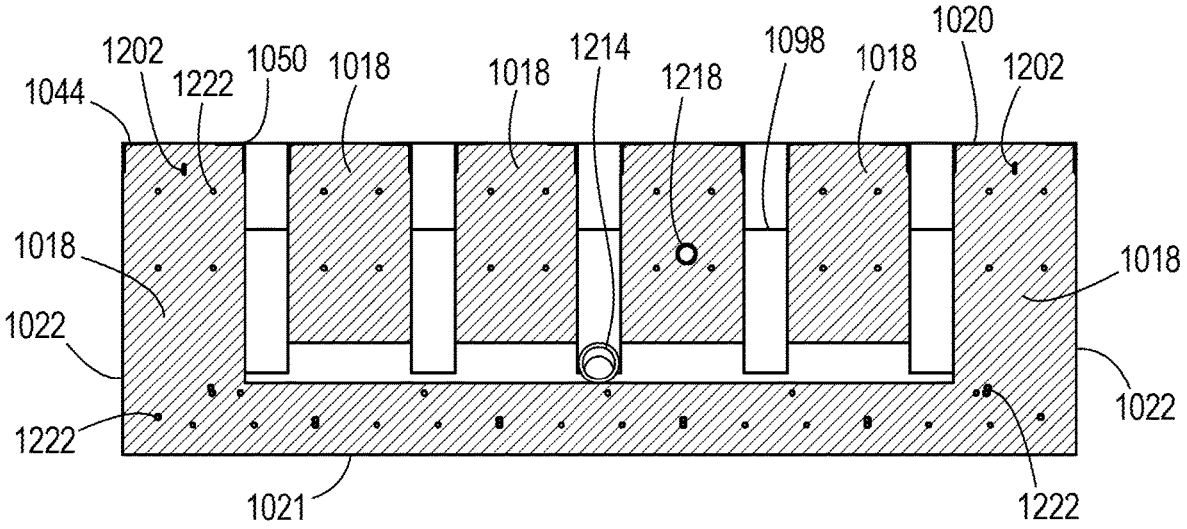
FIG. 36 is a cross-sectional view of the automated rumble strip assembly of FIG. 24, taken along lines 36-36 in FIG. 34.
Figure 37:
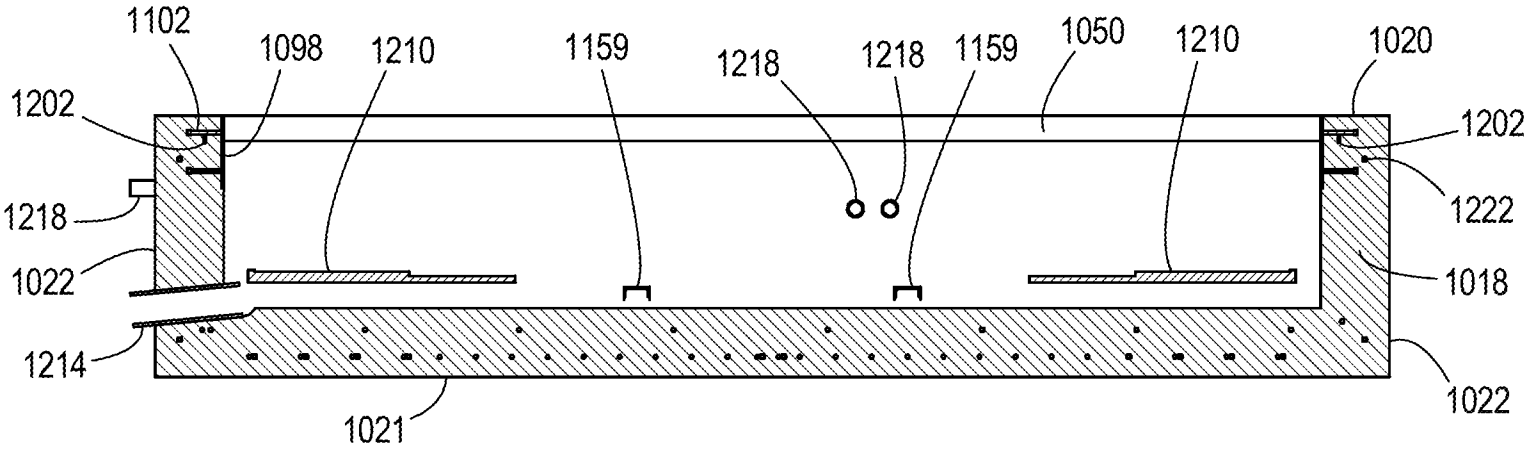
FIG. 37 is a cross-sectional view of the automated rumble strip assembly of FIG. 24, taken along lines 37-37 in FIG. 34.

With reference to FIGS. 36 and 37, in the illustrated construction the automated rumble strip assembly 1010 also includes a drain pipe 1214 disposed below the lower plates 1210. The drain pipe 1214 permits water or other material to pass out of the frame 1014

Figure 35:
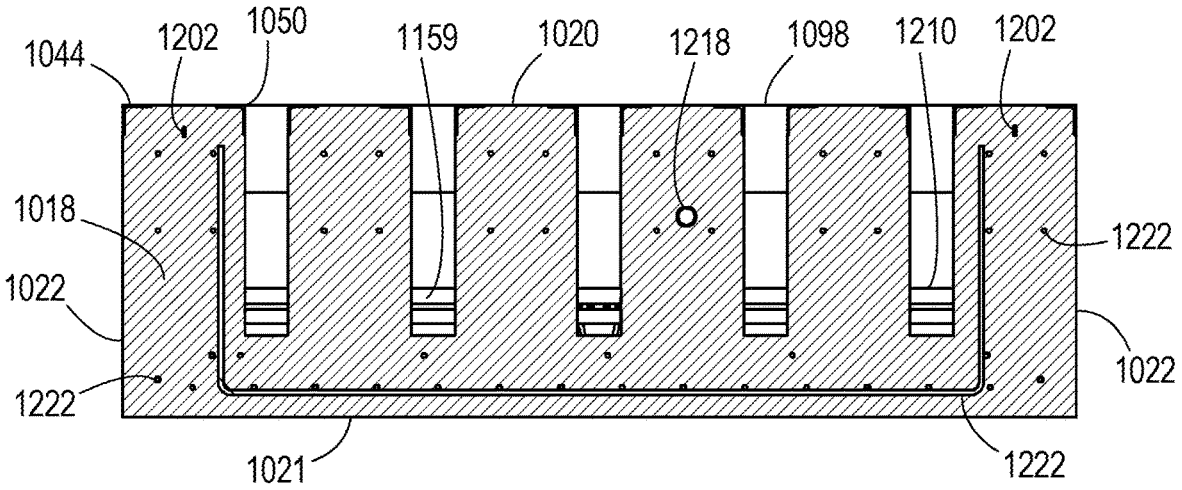
FIG. 35 is a cross-sectional view of the automated rumble strip assembly of FIG. 24, taken along lines 35-35 in FIG. 34.

With reference to FIGS. 35-37, in the illustrated construction the automated rumble strip assembly 1010 also includes at least one electrical conduit 1218. The electrical conduit or conduits 1218 provide space in the frame 1014 for electricity and/or control signals to be delivered to the motors 1110, 1112, 1114, 1116, 1118 and/or object detectors.

Figure 38:
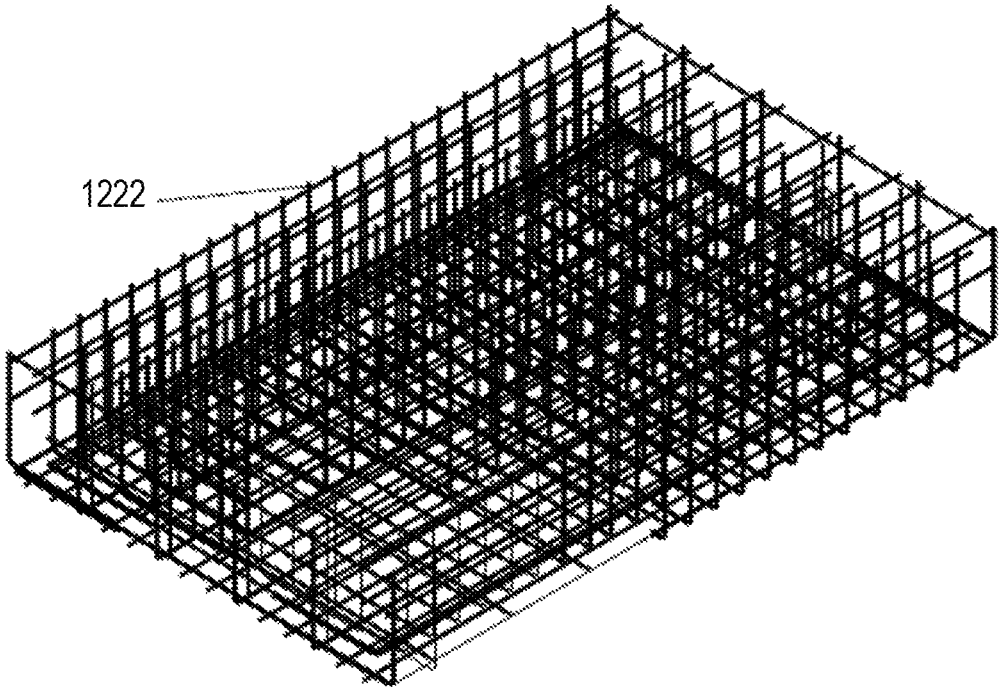
FIGS. 38-40 are perspective, front, and side views respectively of reinforcing elements of the automated rumble strip assembly of FIG. 24.
Figure 39:
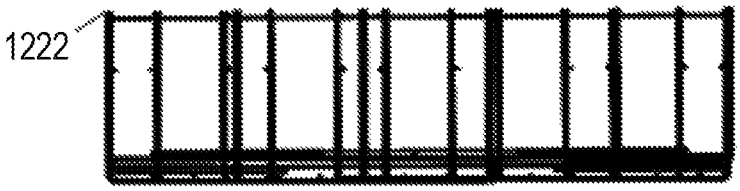
Figure 40:
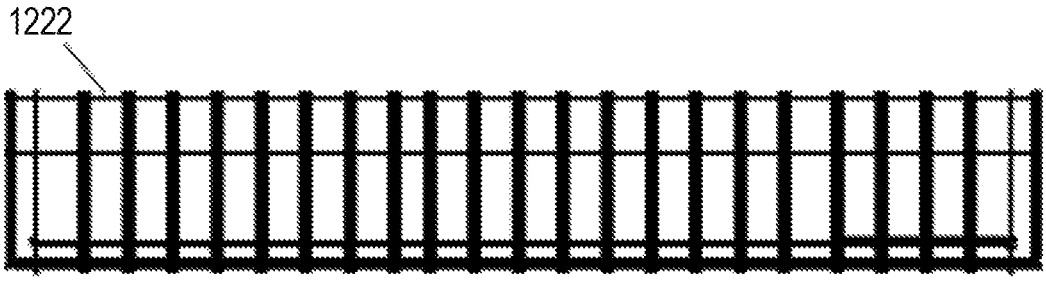

With reference to FIGS. 38-40, in the illustrated construction the automated rumble strip assembly 1010 also includes a plurality of reinforcing elements 1222. The reinforcing elements 1222 provide added structural stability to the frame 1014 and to the overall automated rumble strip assembly 1010. In some constructions the reinforcing elements 1222 are steel rebar elements, although other constructions include different materials or arrangements of reinforcing elements 1222 than that illustrated.

Although the invention has been described in detail with reference to certain preferred embodiments, variations and modifications exist within the scope and spirit of one or more independent aspects of the invention as described.

What is claimed is:

1. An automated rumble strip assembly comprising:

a frame having a top surface configured to support a vehicle tire moving along the frame along a direction of travel, wherein the frame is configured to be coupled to a roadway;

a plurality of elongate members each coupled to the frame and spaced apart from one another along the direction of travel, each elongate member having a top surface; and an actuator assembly configured to simultaneously move each of the elongate members linearly along a direction that is perpendicular to the top surface of the frame and perpendicular to the direction of travel, from a first position relative to the top surface of the frame to a second position relative to the top surface of the frame, to form rumbles for the roadway;

wherein when the elongate members are in the first position each of the top surfaces of the elongate members is flush with the top surface of the frame, and wherein when the elongate members are in the second position each of the top surfaces of the elongate members is recessed relative to the top surface of the frame.

2. The automated rumble strip assembly of claim 1, wherein the frame defines a plurality of elongate apertures open along the top surface of the frame, wherein the elongate apertures extend parallel to one another, and wherein the elongate members are configured to move within the elongate apertures between the first position and the second position.

3. The automated rumble strip assembly of claim 1, wherein the actuator assembly includes a motor and a wedge plate coupled to and driven linearly by the motor, wherein the wedge plate includes a first surface, a second surface, a third surface, a fourth surface, and a fifth surface, wherein the first surface, the third surface, and the fifth surface are parallel to one another and are parallel to the top surface of the frame, wherein the second surface extends between the first surface and the third surface and is sloped relative to both the first surface and the third surface, and wherein the fourth surface extends between the third surface and the fifth surface and is sloped relative to both the third surface and the fifth surface.

4. The automated rumble strip assembly of claim 3, wherein each of the elongate members includes a base portion having a first engagement surface, a second engagement surface, and a third engagement surface, wherein the first engagement surface and the third engagement surface are parallel to one another and are parallel to the top surface of the frame, and wherein the second engagement surface extends between the first engagement surface and the third engagement surface and is sloped relative to both the first engagement surface and the third engagement surface.

5. The automated rumble strip assembly of claim 4, wherein when one of the elongate members is in the first position, the first engagement surface of the base portion is engaged with the third surface of the wedge plate, the second engagement surface of the base portion is engaged with the fourth surface of the wedge plate, and the third engagement surface of the base portion is engaged with the fifth surface of the wedge plate.

6. The automated rumble strip assembly of claim 5, wherein when the one of the elongate members is in the second position, the first engagement surface of the base portion is engaged with the first surface of the wedge plate, the second engagement surface of the base portion is engaged with the second surface of the wedge plate, and the third engagement surface of the base portion is engaged with the third surface of the wedge plate.

7. The automated rumble strip assembly of claim 6, wherein when the elongate member moves from the first position to the second position, the first engagement surface of the base portion slides along the third surface of the wedge plate, and the third engagement surface of the base portion slides along the fifth surface of the wedge plate, and wherein the second engagement surface of the base portion slides along the second surface of the wedge plate until the first engagement surface of the base portion is engaged with the first surface of the wedge plate and the second engagement surface of the base portion is engaged with the second surface of the wedge plate and the third engagement surface of the base portion is engaged with the third surface of the wedge plate.

8. The automated rumble strip assembly of claim 1, wherein the top surface of the frame is a planar surface, and wherein the top surfaces of the elongate members are planar surfaces.

9. The automated rumble strip assembly of claim 1, wherein the actuator assembly is disposed entirely within the frame.

10. The automated rumble strip assembly of claim 1, wherein the plurality of elongate members includes five elongate members, and wherein the five elongate members are spaced equally apart from one another and are parallel to one another.

11. The automated rumble strip assembly of claim 1, wherein the frame includes a concrete main housing.

12. The automated rumble strip assembly of claim 3, wherein the actuator assembly includes a second wedge plate coupled to and driven linearly by the motor, wherein the second wedge plate is driven in an opposite direction than the first wedge plate.

13. The automated rumble strip assembly of claim 12, wherein the motor is a first motor, and wherein the actuator assembly includes a second motor, a third wedge plate coupled to and driven linearly by the second motor, and a fourth wedge plate coupled to and driven linearly by the second motor in an opposite direction than the third wedge plate.

14. The automated rumble strip assembly of claim 3, further comprising a controller coupled to the motor and an object detector coupled to both the controller and to the frame.

15. The automated rumble strip assembly of claim 14, wherein the object detector is selected from a group consisting of an inductive loop wire, a piezoelectric wire, a load cell, a camera detector, an infrared detector, a probe sensor, and an ultrasonic sensor.

16. The automated rumble strip assembly of claim 14, wherein the controller is configured to activate the motor and simultaneously move the elongate members from the first position to the second position only when the object detector detects that a vehicle is not positioned on the frame.

17. The automated rumble strip assembly of claim 1, wherein the frame includes steel reinforcing members, and the frame is configured to be removably coupled to a roadway.

18. An automated rumble strip assembly comprising:

a frame having a top surface configured to support a vehicle tire moving along the frame along a direction of travel, wherein the frame is configured to be coupled to a roadway;

a plurality of elongate members each coupled to the frame and spaced apart from one another along the direction of travel, each elongate member having a top surface; and an actuator assembly configured to simultaneously move each of the elongate members linearly along a direction that is perpendicular to the top surface of the frame and perpendicular to the direction of travel, from a first position relative to the top surface of the frame to a second position relative to the top surface of the frame, to form rumbles for the roadway;

wherein each of the elongate members includes an elongate upper body having a generally rectangular cross-section and further having the top surface of the elongate member, wherein each of the elongate members further includes a support member coupled to and extending beneath the upper body, wherein each of the elongate members further includes a base portion coupled to and extending beneath the support member, wherein the base portion includes a first engagement surface, a second engagement surface, and a third engagement surface, wherein the first engagement surface is parallel to the third engagement surface and wherein the second engagement surface extends between the first engagement surface and the third engagement surface.

19. The automated rumble strip assembly of claim 18, wherein each elongate member includes a plurality of support members extending beneath the upper body, wherein at least one of the base members extends between two of the support members, wherein each of the upper bodies additionally includes a hollow space, and wherein each of the elongate members further includes a dampening material disposed within the hollow space.

20. The automated rumble strip assembly of claim 18, wherein the actuator assembly is disposed at least partially within the frame, wherein the actuator assembly includes a motor and a wedge plate configured to be driven linearly by the motor, wherein the wedge plate includes surfaces configured to engage the first engagement surface, the second engagement surface, and the third engagement surface of one of the base members so as to move the elongate member relative to the top surface of the frame.

21. The automated rumble strip assembly of claim 1, wherein a positioning of the elongate members in the second position is configured to cause a vehicle tire to rise and fall more than once as the vehicle tire travels across the automated rumble strip assembly, wherein the positioning of the elongate members in the second position is configured to cause the vehicle tire to sequentially travel along the top surface of the frame, to then travel along the top surface of one of the elongate members, to then travel further along the top surface of the frame, and to then travel along the top surface of another of the elongate members, wherein the positioning of the elongate members in the second position is configured to generate both noise and vibration as the vehicle travels along the direction of travel over the automated rumble strip assembly.

22. A rumble system for raising driver awareness, the rumble system comprising:

a roadway; and the automated rumble strip assembly of claim 1 coupled to the roadway.

* * * * *